US010604828B2

(12) United States Patent
Han et al.

(10) Patent No.: US 10,604,828 B2
(45) **Date of Patent: *Mar. 31, 2020**

(54) AL—ZN ALLOY COMPRISING PRECIPITATES WITH IMPROVED STRENGTH AND ELONGATION AND METHOD OF MANUFACTURING THE SAME

(71) Applicant: KOREA INSTITUTE OF MACHINERY & MATERIALS, Daejeon (KR)

(72) Inventors: Seung-Zeon Han, Changwon-si (KR); Jee-Hyuk Ahn, Changwon-si (KR); Min-Soo Kim, Changwon-si (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 241 days.

This patent is subject to a terminal disclaimer.

(21) Appl. No.: 15/617,152

(22) Filed: Jun. 8, 2017

(65) Prior Publication Data

US 2017/0356072 A1 Dec. 14, 2017

(30) Foreign Application Priority Data

Jun. 9, 2016 (KR) ..... 10-2016-0071883

(51) Int. Cl.
*C22F 1/053* (2006.01)
*C22C 21/10* (2006.01)

(52) U.S. Cl.
CPC ..... *C22F 1/053* (2013.01); *C22C 21/10* (2013.01)

(58) Field of Classification Search
CPC ..... C22F 1/053; C22C 21/10
USPC ..... 420/532
See application file for complete search history.

(56) References Cited

U.S. PATENT DOCUMENTS 3,676,115 A * 7/1972 Hare ..... C22C 18/04 148/564
2018/0298474 A1* 10/2018 Han ..... C22C 21/10

FOREIGN PATENT DOCUMENTS

JP 2000-096166 A 4/2000
KR 10-1274063 B1 6/2013
KR 10-2017-0014282 A 2/2017

OTHER PUBLICATIONS

Japanese Office Action dated Apr. 20, 2018, issued in corresponding Japanese Patent Application No. 2017-111175.
Shiming Hao et al., "Effect of Cu on Discontinuous Precipitation of a Symmetrical AlZn Alloy", J. Mater. Sci Technol., vol. 21 No. 2, 2005, 215-218 pages.

* cited by examiner

*Primary Examiner* — Weiping Zhu
(74) *Attorney, Agent, or Firm* — Hauptman Ham, LLP

(57) ABSTRACT

The present invention relates to an Al—Zn alloy with improved strength and elongation comprising more than 20 parts by weight of zinc relative to the total weight of the alloy and comprising discontinuous precipitates or lamellar precipitates, formed forcibly in 5% or more per unit area. According to the present invention, the tensile strength and the elongation of an Al—Zn alloy are simultaneously improved.

14 Claims, 31 Drawing Sheets
(17 of 31 Drawing Sheet(s) Filed in Color)

Area ratio (%) of discontinuous precipitates of an Al-Zn alloy by Zn content

Area ratio (%) of discontinuous precipitates of an Al-Zn-Cu alloy by Zn content

Area ratio (%) of discontinuous precipitates of an Al-Zn-Cu alloy by Cu content (Al-35Zn base)

Area ratio (%) of discontinuous precipitates of an Al-Zn-Cu alloy by Cu content (Al-45Zn base)

$((111)_{Al} // (002)_{Zn}, [011]_{Al} // [110]_{Zn})$

AL—ZN ALLOY COMPRISING PRECIPITATES WITH IMPROVED STRENGTH AND ELONGATION AND METHOD OF MANUFACTURING THE SAME

CROSS-REFERENCE TO RELATED APPLICATION

This application claims the benefit under 35 USC § 119(a) of Korean Patent Application No. 10-2016-0071883 filed on Jun. 9, 2016 in the Korean Intellectual Property Office, the entire disclosure of which is incorporated herein by reference for all purposes.

TECHNICAL FIELD

The present invention relates to an Al—Zn alloy comprising precipitates with improved strength and elongation and a method of manufacturing the same. More particularly, the present invention relates to an Al—Zn alloy and a method of manufacturing the same, wherein the strength and the elongation of the Al—Zn alloy are both improved at the same time, including of discontinuous precipitates in a specific form.

DESCRIPTION OF RELATED ART

An aluminum alloy is a lightweight alloy and is used as a structural material because of its excellent corrosion resistance and thermal conductivity. Since aluminum has a poor mechanical property, an aluminum alloy including one or more of metals such as zinc, copper, silicon, magnesium, nickel, cobalt, zirconium, cerium and the like has been widely used as a structural material such as an interior/exterior material of automobiles, ships, aircraft, etc. The Al—Zn alloy is an aluminum alloy used to improve the hardness of aluminum, usually including 10 to 14 wt % zinc based on the total weight of the alloy.

In order to be used as a structural material for ships, aircraft, etc., tensile strength, elongation, and shock absorption energy are considered to be important mechanical characteristics. Generally, it is difficult to improve both tensile strength and elongation at the same time because the tensile strength and the elongation are in a trade-off relationship in which one property is improved and the other property is attenuated.

In order to improve the tensile strength, studies on precipitation hardening, dispersion strengthening, work hardening, solid solution strengthening and grain refinement have been continued. Among them, the precipitation hardening is a phenomenon in which other phases in a matrix are precipitated during the heat treatment and precipitates act as obstacles to dislocation motion, such that an alloy becomes harder and stronger using particle strengthening.

In the precipitation hardening process of an Al—Zn alloy, continuous precipitates (CP) are precipitated from the supersaturated solid solution and distributed small and uniformly throughout the specimen, while discontinuous precipitates (DP) are produced since grain boundary diffusion and grain boundary migration cause irregular precipitation and thus composition and crystal orientation are changed discontinuously at the grain boundaries.

In general, since the tensile strength of discontinuous precipitates (DP) is lower than that of continuous precipitates (CP), studies that suppress discontinuous precipitates are predominantly underway.

Korean Patent No. 10-1274063 discloses a metal composite material having oriented precipitates in which Ni+Si, titanium or vanadium is added to a copper alloy to improve strength and electric conductivity, and a method for manufacturing the same.

As described above, there are problems in that increasing the tensile strength of the aluminum alloy reduces the elongation, and improving the elongation lowers the tensile strength.

SUMMARY

An object of the present invention is to provide an Al—Zn alloy comprising oriented precipitates with improved tensile strength and elongation at the same time.

Another object of the present invention is to provide a method for efficiently producing an Al—Zn alloy comprising oriented precipitates with improved tensile strength and elongation.

Other objects and advantages of the present invention will become more apparent from the following detailed description, claims and drawings of the invention.

According to an aspect of the present invention, there is provided an Al—Zn alloy with improved strength and elongation, comprising more than 20 parts by weight of zinc relative to the total weight of the alloy and comprising 5% or more per unit area of discontinuous precipitates or lamellar precipitates forced to be formed.

According to another aspect of the present invention, there is provided an Al—Zn alloy with improved strength and elongation, comprising discontinuous precipitates or lamellar precipitates, wherein the discontinuous precipitates or the lamellar precipitates have an average aspect ratio of at least 20 and are oriented.

According to another aspect of the present invention, there is provided an Al—Zn alloy with improved strength and elongation, comprising discontinuous precipitates or lamellar precipitates, wherein an average length of the discontinuous precipitates or the lamellar precipitates is greater than or equal to 1.4 μm.

According to an embodiment of the present invention, an average spacing between the discontinuous precipitates or the lamellar precipitates may be 105 nm or less.

According to an embodiment of the present invention, an average thickness of the discontinuous precipitates or the lamellar precipitates may be 55 nm or less.

According to an embodiment of the present invention, the discontinuous precipitates or the lamellar precipitates may be oriented.

According to an embodiment of the present invention, the discontinuous precipitates or the lamellar precipitates may be formed by a heat treating treatment of the Al—Zn alloy to produce a solid solution and an aging treatment.

According to an embodiment of the present invention, the Al—Zn alloy may further include a precipitation accelerating metal.

The precipitation accelerating metal may be at least one selected from copper (Cu), titanium (Ti), silicon (Si), iron (Fe), manganese (Mn), magnesium (Mg), and chromium (Cr).

The precipitation accelerating metal may be copper (Cu), and the copper may be included in an amount of 0.05 to 5 parts by weight based on the total weight of the alloy.

According to an embodiment of the present invention, when the tensile strength of the Al—Zn alloy is 300 MPa to 400 MPa, the elongation may be 10% or more.

According to an embodiment of the present invention, when the tensile strength of the Al—Zn alloy is 400 MPa to 500 Mpa, the elongation may be 5% or more.

According to another aspect of the present invention, there is provided a method of manufacturing an Al—Zn alloy with simultaneously improved tensile strength and elongation, comprising: preparing an Al—Zn alloy comprising zinc in an amount of more than 20 parts by weight based on the total weight of the alloy; heat treating the Al—Zn alloy to form a solid solution; aging the Al—Zn alloy comprising the solid solution to force forming 5% or more of discontinuous precipitates or lamellar precipitates per unit area; and orienting to form oriented precipitates by calcining the Al—Zn alloy comprising the precipitates.

According to an embodiment of the present invention, the heat treating may be performed by heating at a temperature range of 350 to 450° C. for 30 minutes or more.

According to an embodiment of the present invention, the aging treatment may be performed in a temperature range of 120 to 200° C.

According to an embodiment of the present invention, the aging treatment may be performed for 5 minutes to 400 minutes.

According to an embodiment of the present invention, the preparing an Al—Zn alloy may comprise adding at least one precipitation accelerating metal chosen from copper (Cu), titanium (Ti), silicon (Si), iron (Fe), manganese (Mn), magnesium (Mg), and chromium (Cr) into the alloy.

According to an embodiment of the present invention, the precipitation accelerating metal may be copper, and the copper may be included in an amount of 0.05 to 5 parts by weight based on the total weight of the alloy.

According to an embodiment of the present invention, the orienting may be performed with a plastic working of 50% or more.

According to an embodiment of the present invention, the orienting may be performed in a liquid nitrogen atmosphere.

According to an embodiment of the present invention, tensile strength and elongation of the Al—Zn alloy may be improved at the same time by precipitates in an oriented specific form.

According to an embodiment of the present invention, tensile strength and elongation of the Al—Zn alloy may be improved at the same time by easily controlling an amount of precipitates oriented in the Al—Zn alloy manufacturing process.

BRIEF DESCRIPTION OF DRAWINGS

The patent or application file contains at least one drawing executed in color. Copies of this patent or patent application publication with color drawing(s) will be provided by the Office upon request and payment of the necessary fee.

DETAILED DESCRIPTION

While the present disclosure has been described with reference to particular embodiments, it is to be appreciated that various changes and modifications may be made by those skilled in the art without departing from the spirit and scope of the present disclosure, as defined by the appended claims and their equivalents. Throughout the description of the present disclosure, when describing a certain technology is determined to evade the point of the present disclosure, the pertinent detailed description will be omitted.

The terms used in the description are intended to describe certain embodiments only, and shall by no means restrict the present disclosure. Unless clearly used otherwise, expressions in the singular number include a plural meaning. In the present description, an expression such as "comprising" or "consisting of" is intended to designate a characteristic, a number, a step, an operation, an element, a part or combinations thereof, and shall not be construed to preclude any presence or possibility of one or more other characteristics, numbers, steps, operations, elements, parts or combinations thereof.

Hereinafter, an Al—Zn alloy and a method of manufacturing the same according to the present invention will be described in detail with reference to the accompanying drawings.

Figure 1A:
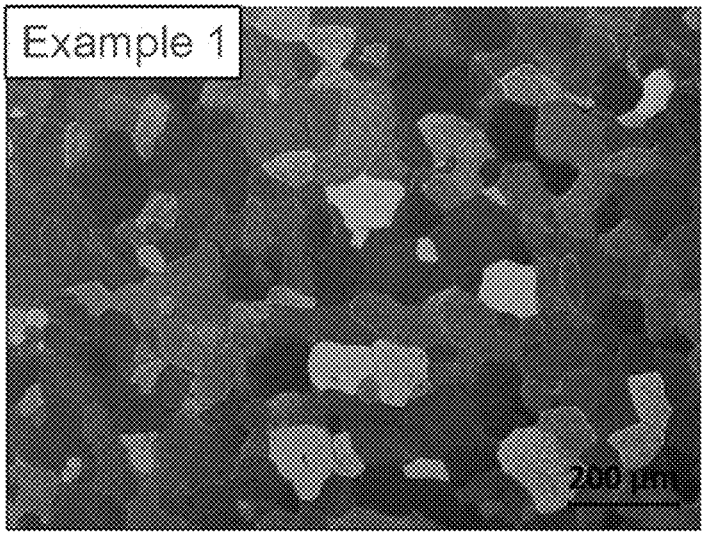
FIG. 1A-FIG. 1F are photomicrographs of Al—Zn alloys according to Examples 1 to 6 of the present invention.
Figure 1B:
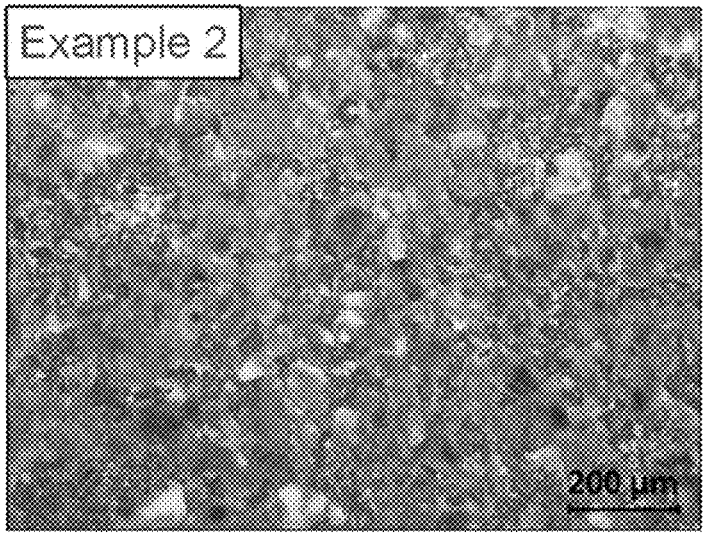
Figure 1C:
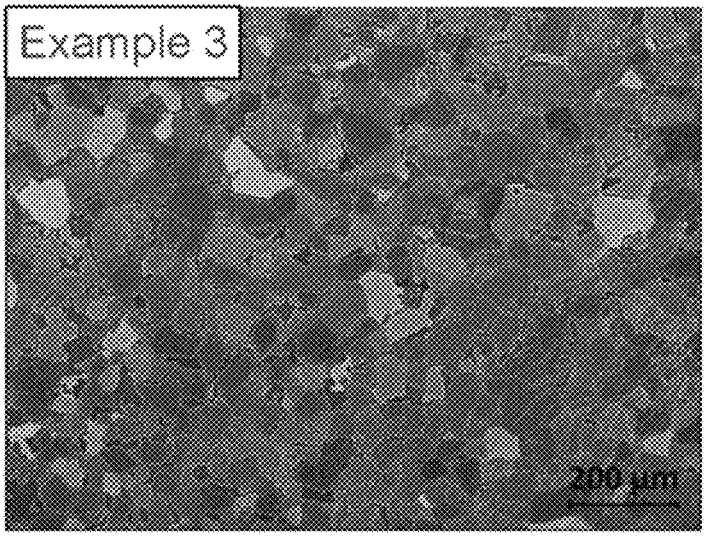
Figure 1D:
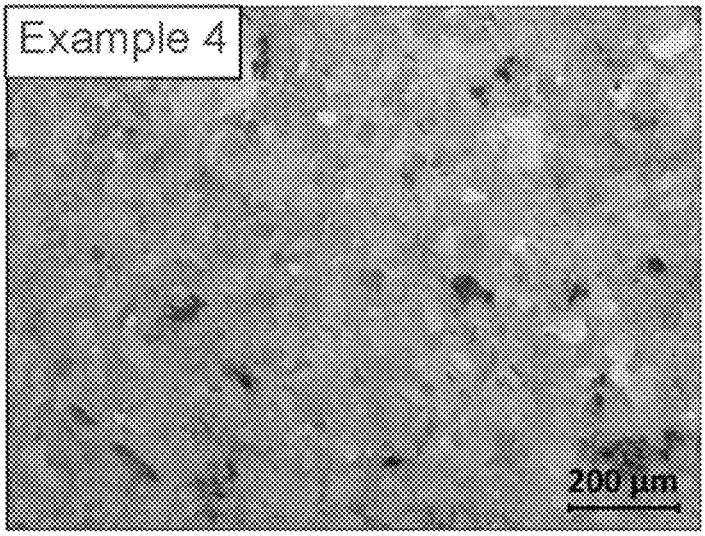
Figure 1E:
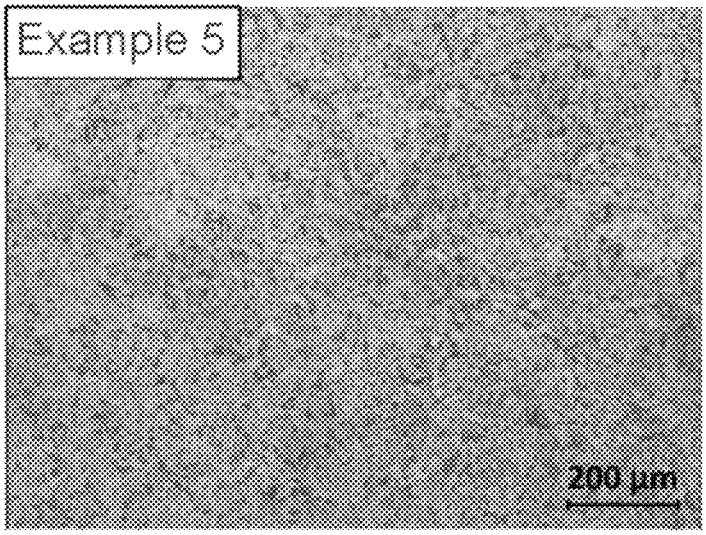
Figure 1F:
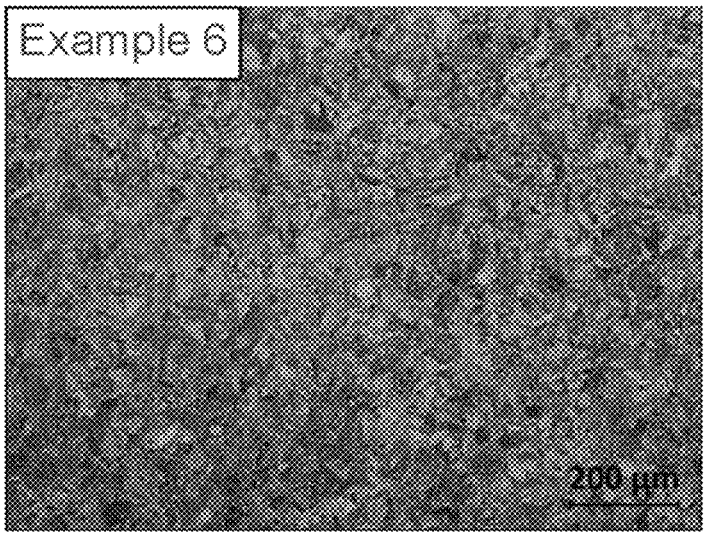
Figure 2A:
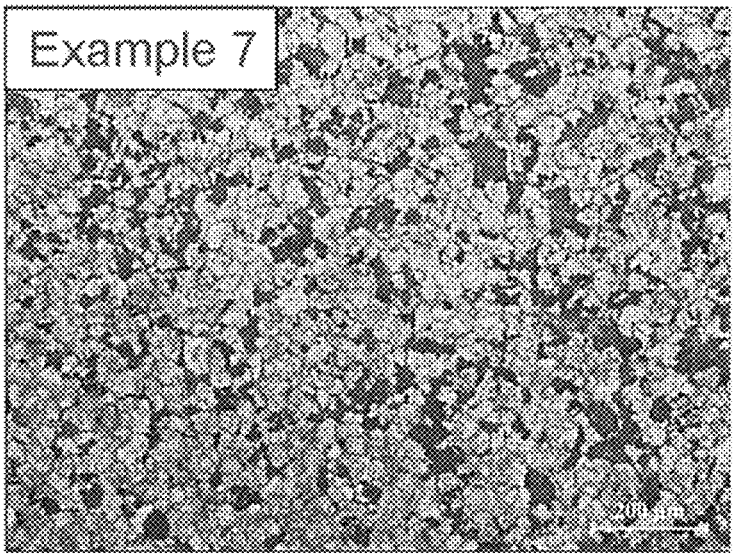
FIG. 2A-FIG. 2H are photomicrographs of Al—Zn alloys according to Examples 7 to 14 of the present invention.
Figure 2B:
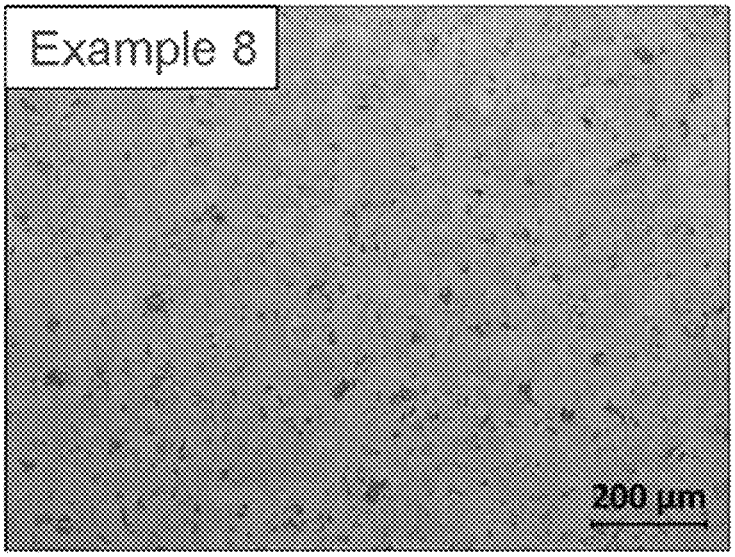
Figure 2C:
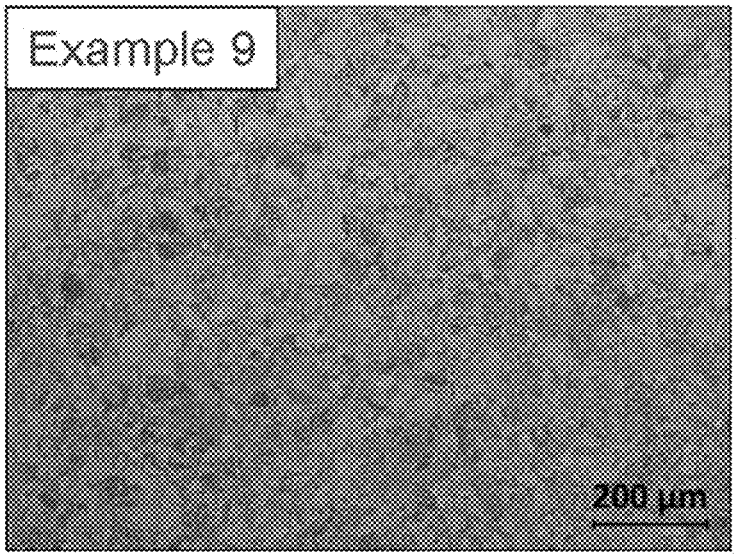
Figure 2D:
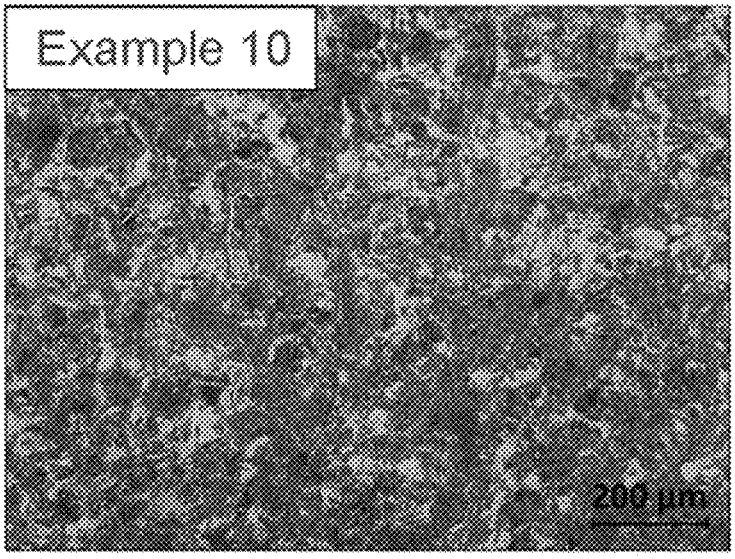
Figure 2E:
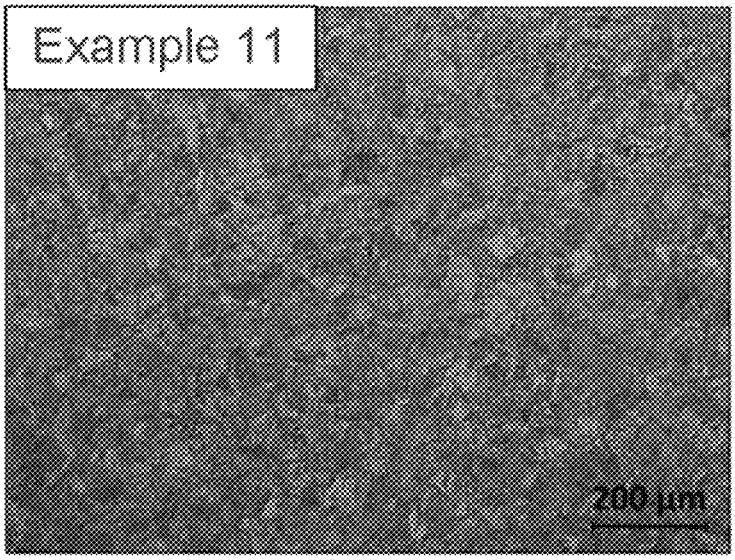
Figure 2F:
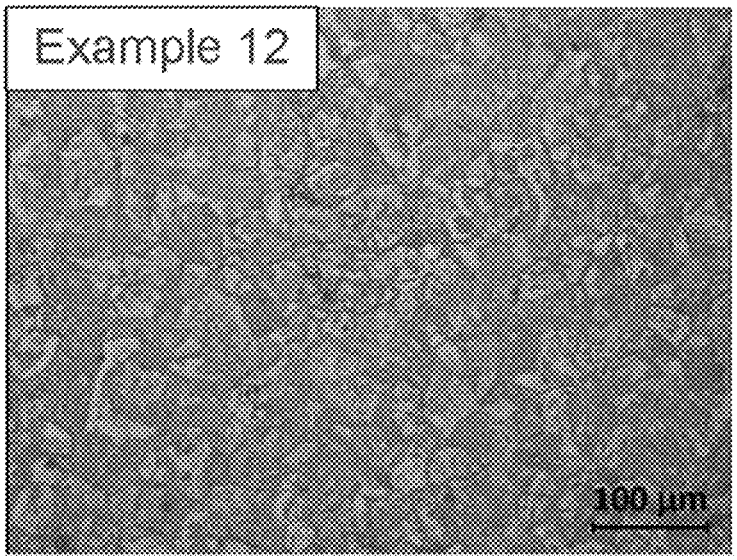
Figure 2G:
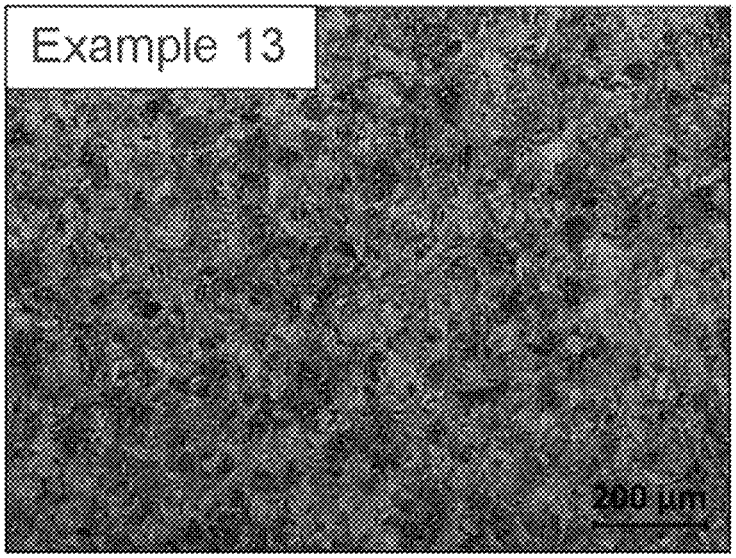
Figure 2H:
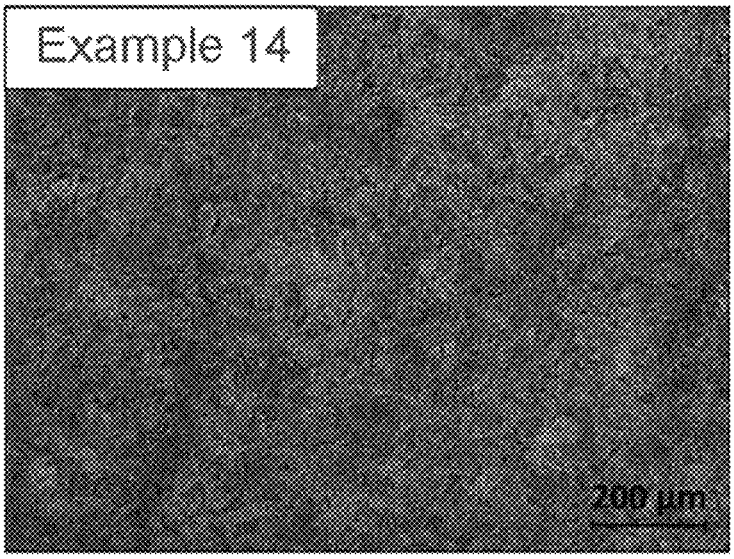
Figure 3A:
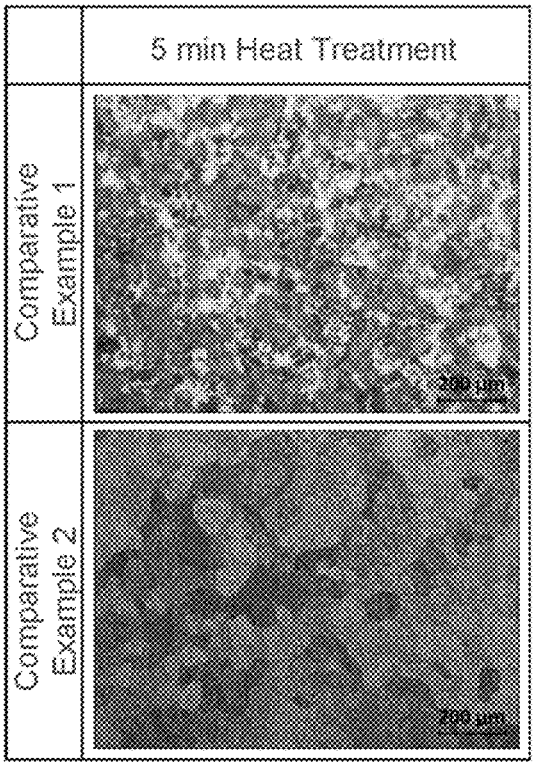
FIG. 3A-FIG. 3C are photomicrographs of Al—Zn alloys according to Comparative Examples 1 and 2 of the present invention.
Figure 3B:
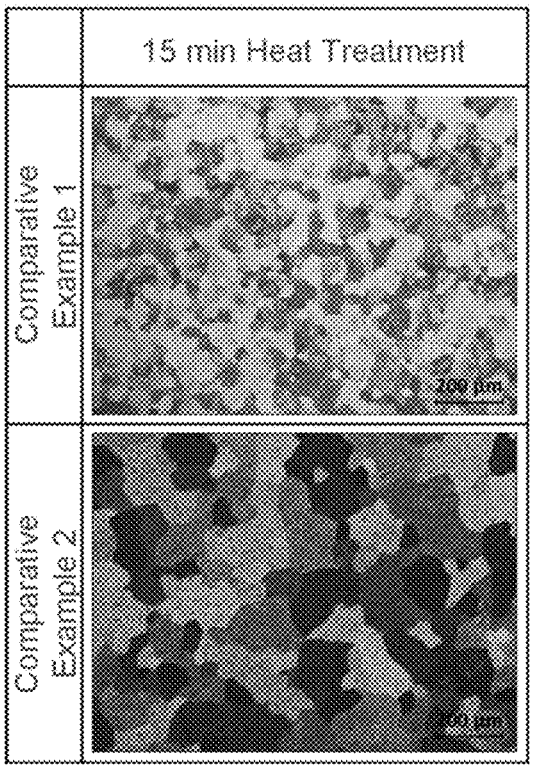
Figure 3C:
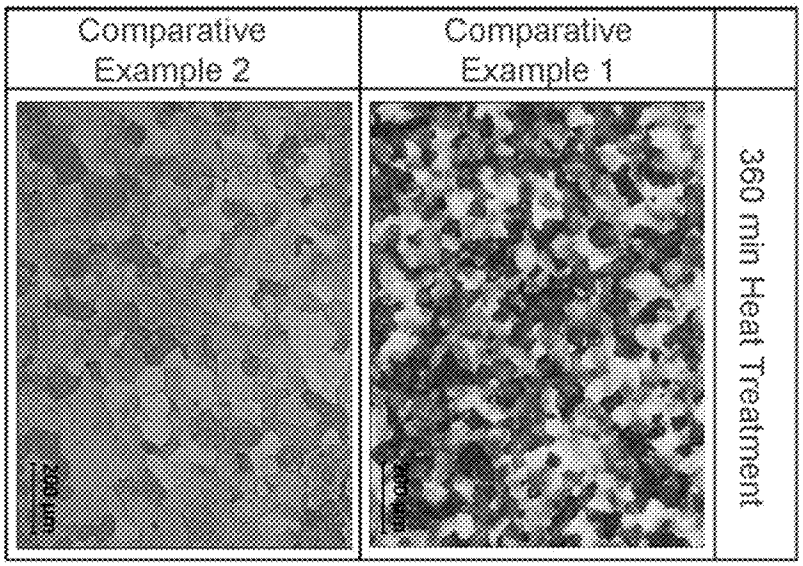

FIG. 1A-FIG. 1F are photomicrographs of Al—Zn alloys according to Examples 1 to 6 of the present invention. FIG. 2A-FIG. 2H are photomicrographs of Al—Zn alloys according to Examples 7 to 14 of the present invention. FIG. 3A-FIG. 3C are photomicrographs of Al—Zn alloys according to Comparative Examples 1 and 2 of the present invention.

An Al—Zn alloy of the present invention is an Al—Zn alloy in which discontinuous precipitates that reduce the mechanical strength are forcibly formed inside the metal. The forcibly formed discontinuous precipitates may be artificially oriented to simultaneously enhance the strength and the elongation of the Al—Zn alloy.

In the present invention, discontinuous precipitates represent a comprehensive or equivalent meaning including lamellar precipitates (hereinafter referred to as lamellar precipitates) or cellular precipitates.

The Al—Zn alloy of the present invention comprises more than 20 parts by weight of zinc relative to the total weight of the alloy. When the content of zinc in the Al—Zn alloy is 20 parts by weight or less, discontinuous precipitates are hardly produced. The content of zinc in the Al—Zn alloy is preferably 30 parts by weight or more.

In addition, 5% or more per unit area of the discontinuous precipitates or the lamellar precipitates are included in the Al—Zn alloy. When the forcibly formed discontinuous precipitates or lamellar precipitates are less than 5% per unit area, it may be difficult to improve strength and elongation at the same time.

An Al—Zn alloy of the present invention includes discontinuous precipitates or lamellar precipitates, wherein the discontinuous precipitates or precipitates have an average aspect ratio of 20 or more. When the average aspect ratio of the discontinuous precipitates or the lamellar precipitates of the Al—Zn alloy is less than 20, it may be difficult to improve the tensile strength and the elongation of the Al—Zn alloy at the same time. The average aspect ratio may be 20 or more per unit area of 3.5 μm×3.5 μm, but it is not limited thereto.

An Al—Zn alloy of the present invention includes discontinuous precipitates or lamellar precipitates, wherein the discontinuous precipitates or the lamellar precipitates have an average length of 1.4 μm or more. If the average length of the discontinuous precipitates or the lamellar precipitates is less than 1.4 μm, it may be difficult to improve the tensile strength and the elongation of the Al—Zn alloy at the same time. The average length may be less than 1.4 μm per unit area of 3.5 μm×3.5 μm, but it is not limited thereto.

In the present invention, when an average spacing between the precipitates of the discontinuous precipitates or the lamellar precipitates is 105 nm or less, the tensile strength and the elongation of the Al—Zn alloy may be suitably improved at the same time. However, it is not limited thereto. For example, the average spacing between the precipitates may be 105 nm or less per unit area of 3.5 μm×3.5 μm.

In the present invention, when an average thickness of the discontinuous precipitates or the lamellar precipitates is 55 nm or less, the tensile strength and the elongation of the Al—Zn alloy may be suitably improved at the same time. However, it is not limited thereto. For example, the average thickness of the precipitates may be 55 nm or less per unit area of 3.5 μm×3.5 μm.

In the present invention, the discontinuous precipitates or the lamellar precipitates may be oriented. It may be suitable to improve the tensile strength and the elongation of an Al—Zn alloy at the same time by artificial orientation. The orientation of the aluminum-alloy according to the present invention may be achieved by plastic working. The plastic working may be selected from various processes such as drawing, rolling, and extrusion.

The discontinuous precipitates or the lamellar precipitates of an Al—Zn alloy of the present invention may be formed by subjecting the Al—Zn alloy to a heat treatment to form a solid solution, followed by an aging treatment. The production of the Al—Zn alloy will be described later in detail with reference to FIG. 4.

A precipitation accelerating metal may be further added to promote the formation of precipitates during the production of the Al—Zn alloy of the present invention. The precipitation accelerating metal may be at least one chosen from copper (Cu), titanium (Ti), silicon (Si), iron (Fe), manganese (Mn), magnesium (Mg), and chromium (Cr).

The precipitating accelerating metal may be copper (Cu), and the copper may be included in an amount of 0.05 to 5 parts by weight based on the total weight of the alloy, but it is not limited thereto.

When the tensile strength of an Al—Zn alloy of the present invention is 300 MPa to 400 MPa, the elongation may be 10% or higher. In addition, when the tensile strength of an Al—Zn alloy of the present invention is 400 MPa to 500 MPa, the elongation may be 5% or higher. The Al—Zn alloy of the present invention may improve the tensile strength and the elongation at the same time.

Figure 4:
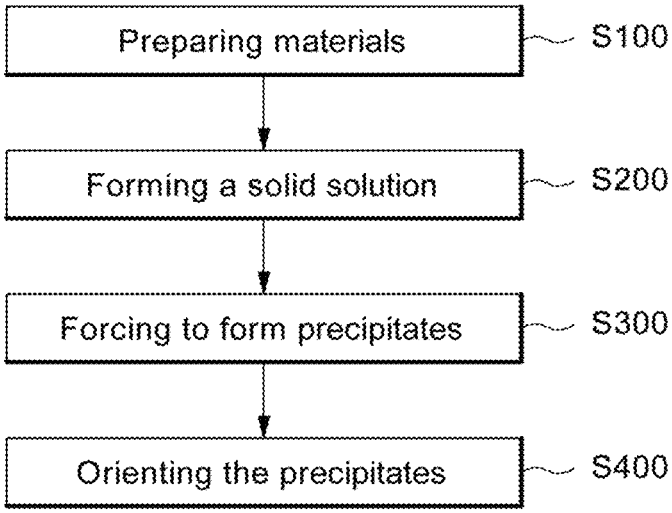
FIG. 4 is a flowchart illustrating a method of manufacturing an Al—Zn alloy according to an embodiment of the present invention.

FIG. 4 is a flowchart illustrating a method of manufacturing an Al—Zn alloy according to an embodiment of the present invention.

Referring to FIG. 4, an aluminum-zinc alloy material including zinc in an amount of more than 20 parts by weight based on the total weight of the alloy is prepared (S100).

More specifically, zinc is included in an amount of more than 20 parts by weight and aluminum in an amount of 80 parts or less by weight based on the total weight of the Al—Zn alloy. The weight ratio of aluminum to zinc may be greater than 80:20 but less than 50:50, preferably greater than 70:30 and less than 50:50, and more preferably greater than 60:40 and less than 50:50.

At this time, the above precipitation accelerating metal may be selectively prepared. The precipitation accelerating metal may be as described above.

After the alloy material is prepared as described above, a solid solution is produced using the alloy material (S200). The step of producing a solid solution is a step for removing residual precipitates. If the precipitating accelerating metal is included in the step of preparing the alloy material (S100), the solid solubility may be lowered.

The solid solution may be formed by heat-treating the alloy. The heat treatment may be a homogenization treatment and/or a solubilization treatment. Due to the formation of the solid solution, the Al—Zn alloy becomes a state including the solid solution.

A temperature range of the step of producing a solid solution may be from 350 to 450° C. The temperature range may be determined by taking into account the maximum solid solution-limit temperature at which an Al—Zn alloy does not form a liquid phase and forms a solid solution. The Al—Zn alloy does not form discontinuous precipitates because it forms a polyphase without forming a single phase at a temperature of higher than 450° C. The step of producing a solid solution may be performed by heating for 30 minutes or more.

The discontinuous precipitates are forcibly formed using the Al—Zn alloy including the solid solution (S300).

The step of forcibly producing the precipitates is producing discontinuous precipitates or lamellar precipitates within the alloy, which comprises aging the aluminum-alloy including the solid solution to form 5% or more of discontinuous precipitates or lamellar precipitates per unit area.

The aging treatment may be performed at a temperature of 120 to 200° C. which is lower than the step of forming the solid solution may. For example, the aging treatment may be performed at 160° C. The aging treatment may be performed for 5 minutes to 400 minutes. For example, in the case where the alloy material includes a precipitation accelerating metal, water quenching or air quenching may be performed after producing the solid solution, and the aging treatment may be performed for at least 2 hours forcibly to produce discontinuous precipitates, while the aging treatment may be performed for at least 5 hours in the case where the alloy material does not include a precipitation accelerating metal.

As described above, the water quenching or the air quenching before the aging treatment may form oriented precipitates later by rapidly quenching the temperature lowering speed. If the temperature is slowed down by slowing down the temperature lowering speed, these precipitates may not be oriented even if they are forced to produce discontinuous precipitates or lamellar precipitates.

After forcibly forming the discontinuous precipitates or the lamellar precipitates as described above, the Al—Zn alloy including the precipitates is calcined to form oriented precipitates (S400).

The step for orienting to form oriented precipitates is a process of artificially orienting the forcibly formed discontinuous precipitates, which may be performed by rolling, drawing and/or extruding. A drawing ratio, which is a reduction rate of a cross-sectional area, may be 50% or more. As the draw ratio increases, the distance between the oriented precipitates and the thickness of the oriented precipitates themselves may decrease, and the tensile strength may be improved The orientation step may be performed in a liquid nitrogen atmosphere. When oriented in a liquid nitrogen atmosphere, the heat generated in the orientation step may be minimized, facilitating the orientation of the discontinuous precipitates, resulting in increased tensile strength.

Figure 29:
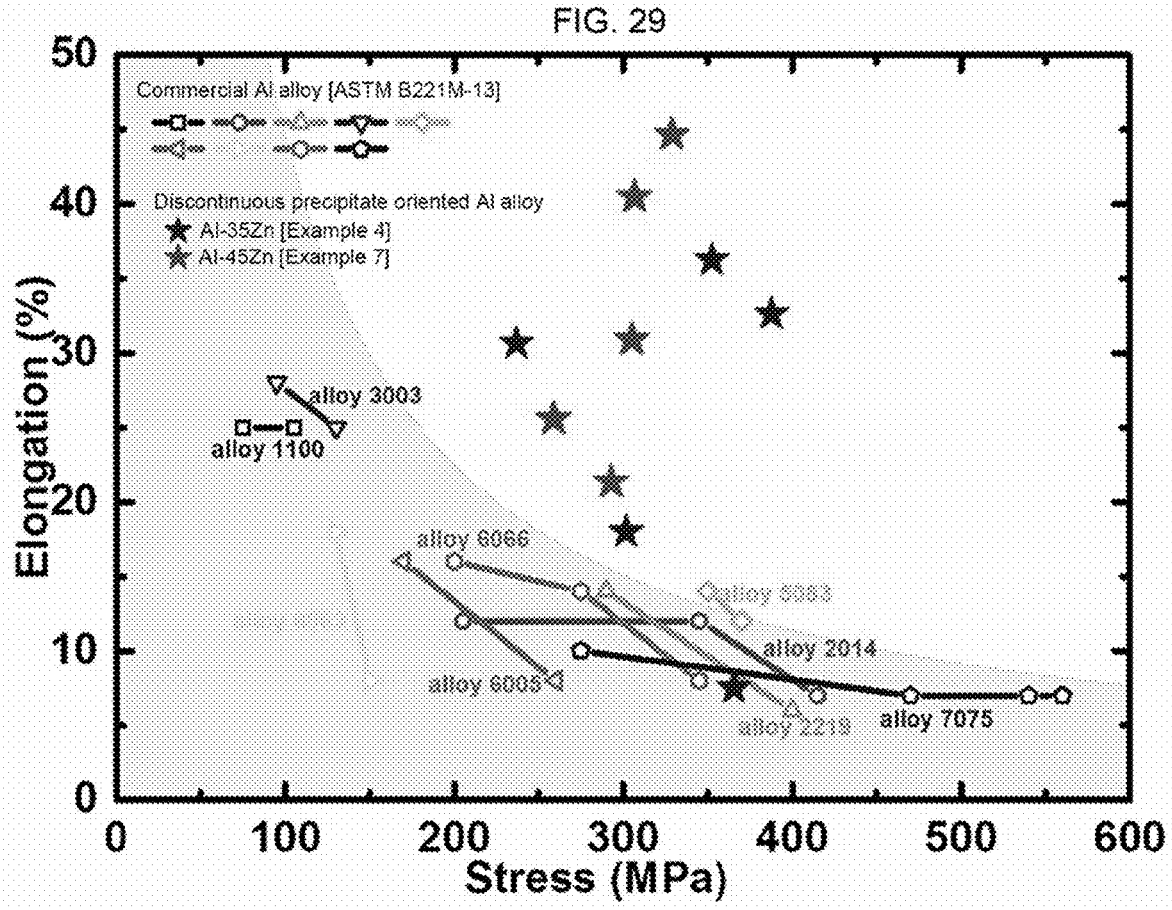
FIG. 29 is a graph illustrating that an Al—Zn alloy according to the embodiments of the present invention is improved in tensile strength and elongation at the same time as compared with a conventional alloy.

As described above, the Al—Zn alloy of the present invention forcibly forms discontinuous precipitates or lamellar precipitates during the manufacturing process, and includes the oriented precipitates formed by using the same, whereby the tensile strength and the elongation are simultaneously improved (See FIG. 29).

EXAMPLES

Hereinafter, the present invention will be described in more detail with reference to specific production examples and comparative examples of the present invention along with the results of the characteristics evaluation thereof.

Examples 1-26 and Comparative Examples 1-2

Table 1 shows contents of Examples and Comparative Examples of an Al—Zn alloy of the present invention.

The Al—Zn alloy of Table 1 was casted by electric furnace melting and high-frequency induction melting. A homogenization treatment was performed at 370° C. for 30 hours in order to remove impurities generated during casting. Subsequently, heat treatment was performed at a reduction rate of 20% at 400° C. every 15 minutes to perform swaging at a total cold working area reduction rate of 75%. After 1 hour had elapsed, the resultant solution was subjected to solution treatment at 400° C. for 1 hour and then water-quenched. It was then subjected to precipitation treatment to produce discontinuous precipitates at 160° C.

TABLE 1

| | Category | | | | | | | | |
|---|---|---|---|---|---|---|---|---|---|
| | Al | Zn | Cu | Ti | Si | Fe | Mn | Mg | Cr |
| | content range | | | | | | | | |
| | Bal. | 23~50 | 0.05~5 | 0.05~0.1 | 0.1~0.3 | 0.1~0.5 | 0.1~0.5 | 0.1~5 | 0.1~3 |
| Comparative Examples 1 | Bal. | 20 | | | | | | | |
| Comparative Examples 2 | Bal. | 18 | 2 | | | | | | |

TABLE 1-continued

| | Category | | | | | | | | |
|---|---|---|---|---|---|---|---|---|---|
| | Al | Zn | Cu | Ti | Si | Fe | Mn | Mg | Cr |
| | content range | | | | | | | | |
| | Bal. | 23~50 | 0.05~5 | 0.05~0.1 | 0.1~0.3 | 0.1~0.5 | 0.1~0.5 | 0.1~5 | 0.1~3 |
| Example 1 | Bal. | 23 | 2 | | | | | | |
| Example 2 | Bal. | 30 | | | | | | | |
| Example 3 | Bal. | 28 | 2 | | | | | | |
| Example 4 | Bal. | 35 | | | | | | | |
| Example 5 | Bal. | 33 | 2 | | | | | | |
| Example 6 | Bal. | 32 | 3 | | | | | | |
| Example 7 | Bal. | 45 | | | | | | | |
| Example 8 | Bal. | 44.95 | 0.05 | | | | | | |
| Example 9 | Bal. | 44.9 | 0.1 | | | | | | |
| Example 10 | Bal. | 44.5 | 0.5 | | | | | | |
| Example 11 | Bal. | 44 | 1 | | | | | | |
| Example 12 | Bal. | 43 | 2 | | | | | | |
| Example 13 | Bal. | 42 | 3 | | | | | | |
| Example 14 | Bal. | 40 | 5 | | | | | | |
| Example 15 | Bal. | 50 | | | | | | | |
| Example 16 | Bal. | 48 | 2 | | | | | | |
| Example 17 | Bal. | 32.85 | 2 | 0.05 | 0.1 | | | | |
| Example 18 | Bal. | 32.725 | 2 | 0.075 | 0.2 | | | | |
| Example 19 | Bal. | 32.6 | 2 | 0.1 | 0.3 | | | | |
| Example 20 | Bal. | 32.4 | 2 | | | 0.1 | 0.5 | | |
| Example 21 | Bal. | 32.4 | 2 | | | 0.3 | 0.3 | | |
| Example 22 | Bal. | 32.4 | 2 | | | 0.5 | 0.1 | | |
| Example 23 | Bal. | 32.4 | 2 | | | | | 0.1 | 0.5 |
| Example 24 | Bal. | 29.85 | 2 | | | | | 0.15 | 3 |
| Example 25 | Bal. | 30.9 | 2 | | | | | 2 | 0.1 |
| Example 26 | Bal. | 28 | 2 | | | | | 5 | |

Analysis of Changes in an Area Ratio of Precipitates

Figure 5:
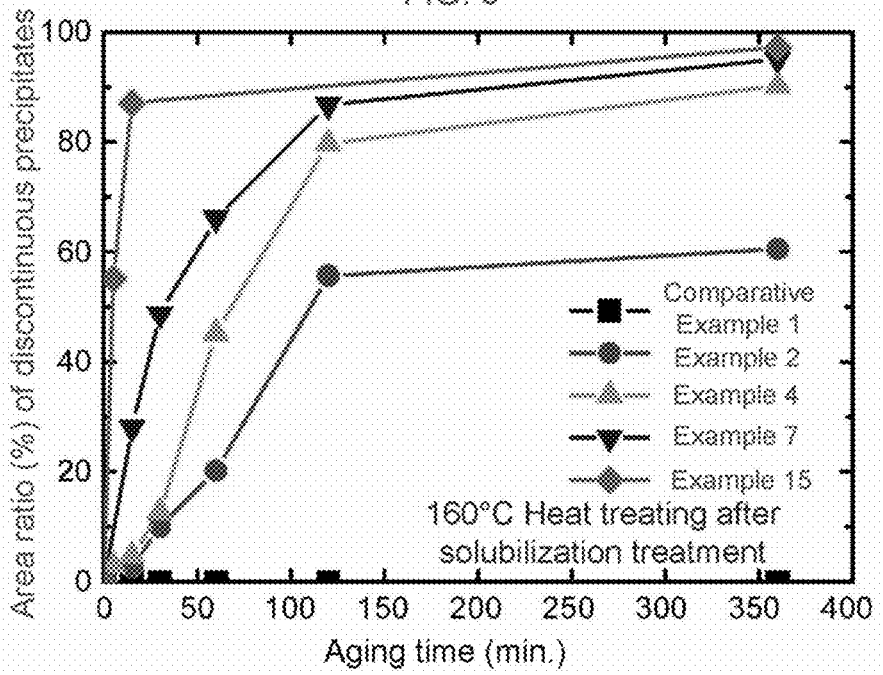
FIG. 5 is a graph illustrating the effect of zinc content and aging time on the formation of discontinuous precipitates according to the present invention.

For each of Examples and Comparative Examples, an area ratio (fraction (%)) of the discontinuous precipitates was measured during the heat treatment at 160° C. as an aging treatment, and the results are shown in FIG. 5.

Figure 6:
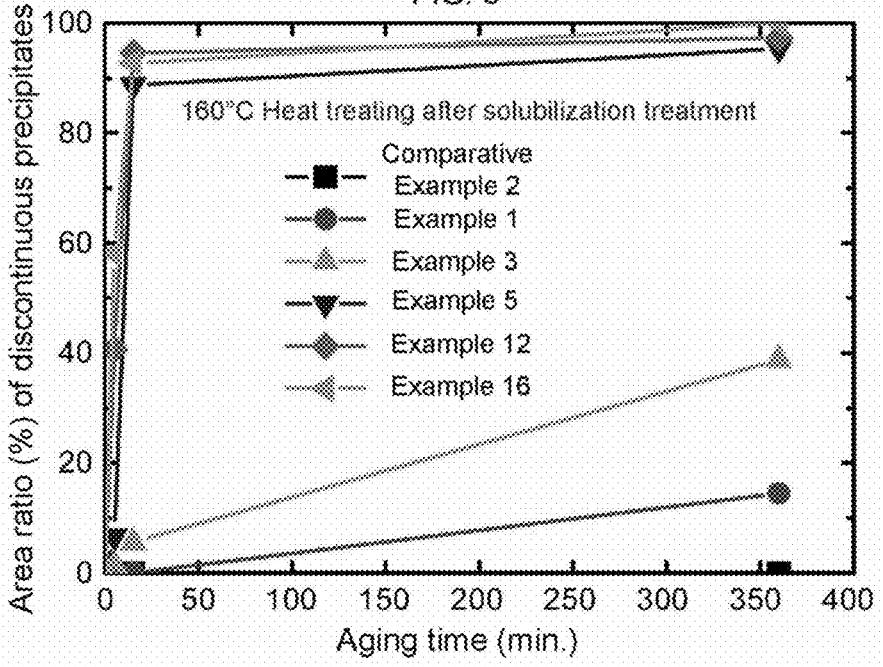
FIG. 6 is a graph illustrating the effect of presence of copper and aging time on the formation of discontinuous precipitates according to the present invention.

FIG. 5 is a graph illustrating the effect of zinc content and aging time on the formation of discontinuous precipitates according to the present invention. FIG. 6 is a graph illustrating the effect of presence of copper and aging time on the formation of discontinuous precipitates according to the present invention.

Referring to FIG. 5 and FIG. 6, the discontinuous precipitates are formed when the aging treatment is performed, but the discontinuous precipitates are not formed at all even though the aging treatment is performed in Comparative Examples 1 and 2. In addition, the discontinuous precipitates are found to be produced more when an amount of zinc is large, copper is added, or the aging time is longer.

Figure 7:
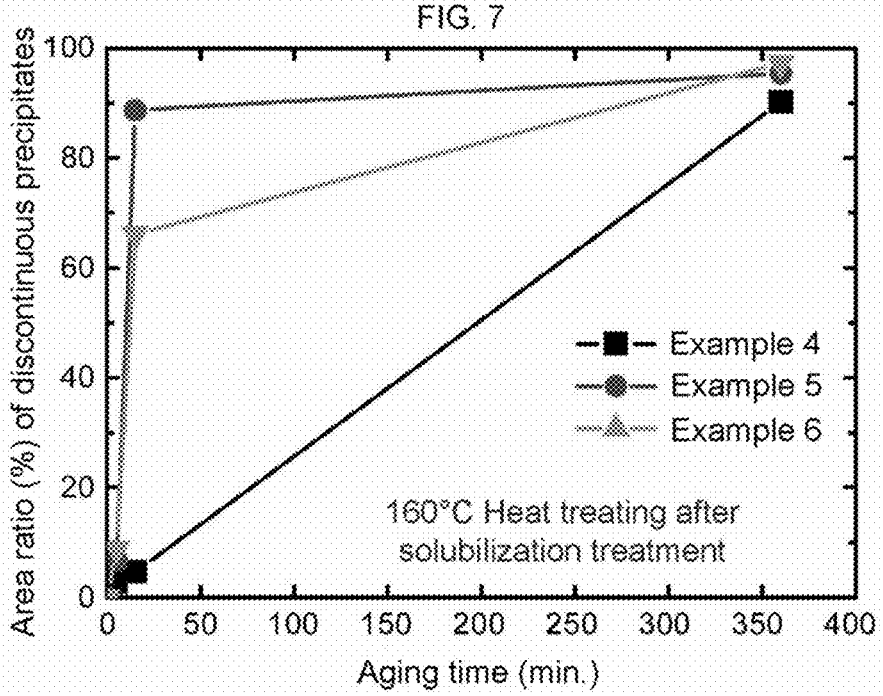
FIG. 7 is a graph illustrating the effect of the copper content of an Al-(35-x)Zn-xCu alloy on the formation of discontinuous precipitates according to the present invention.
Figure 8:
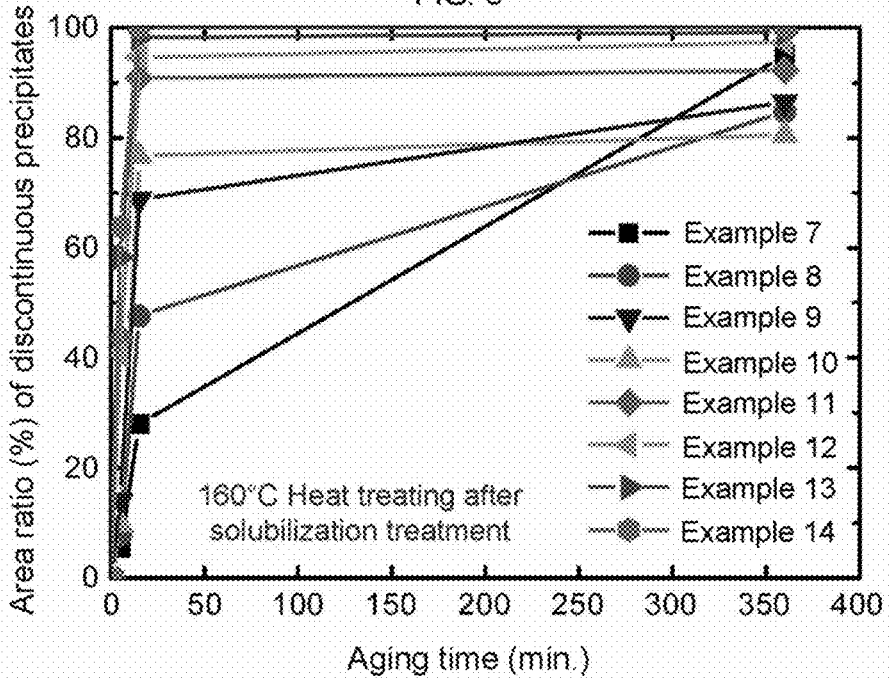
FIG. 8 is a graph illustrating the effect of the copper content of an Al-(45-x)Zn-xCu alloy on the formation of discontinuous precipitates according to the present invention.

FIG. 7 is a graph illustrating the effect of the copper content of an Al-35Zn—Cu alloy on the formation of discontinuous precipitates according to the present invention. FIG. 8 is a graph illustrating the effect of the copper content of an Al-45Zn—Cu alloy on the formation of discontinuous precipitates according to the present invention.

Referring to FIG. 7 and FIG. 8, as the copper content increases, the formation of discontinuous precipitates accelerates and the discontinuous precipitates are more produced.

Analysis of Morpholoqical Chancres of Precipitates

Figure 9:
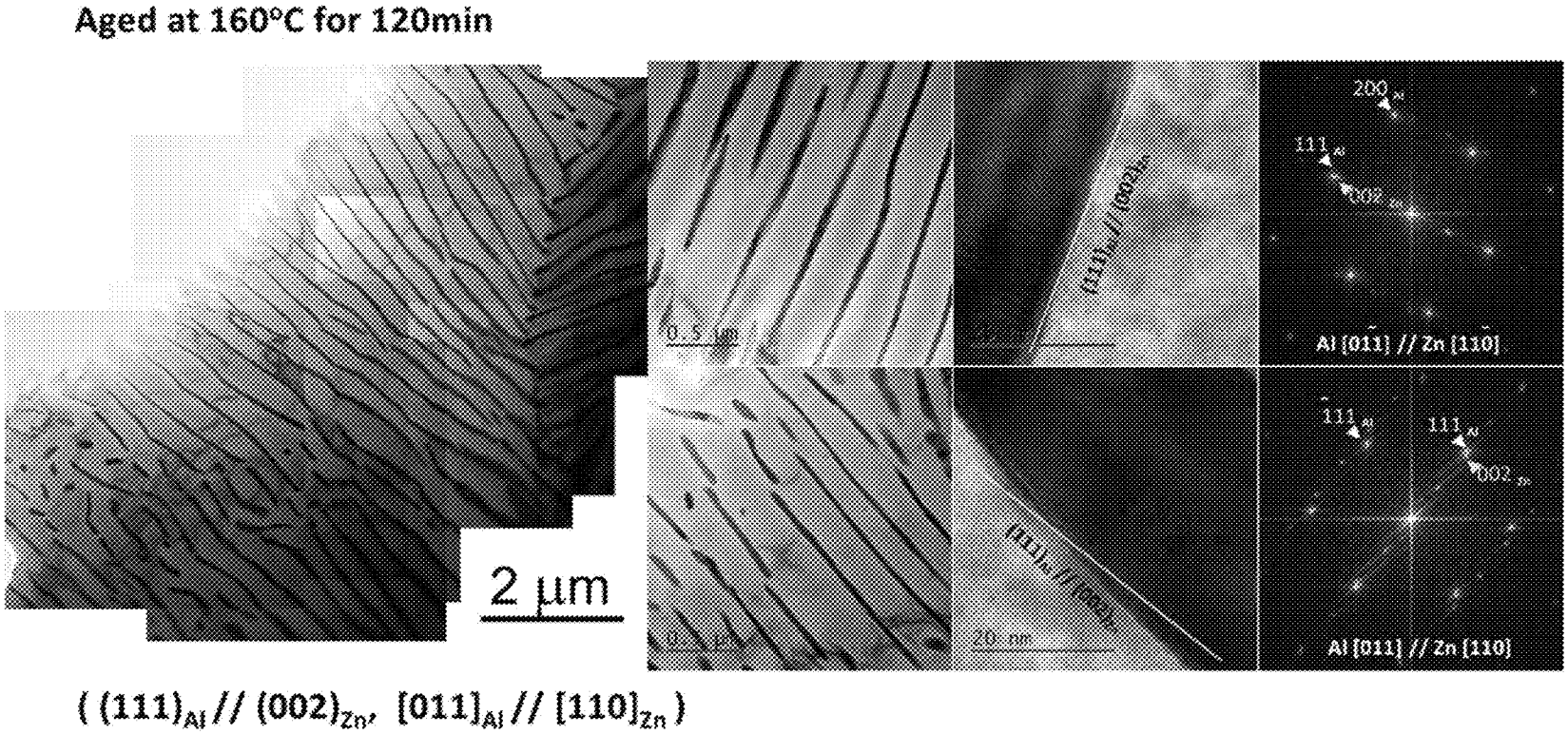
FIG. 9 is TEM images of discontinuous precipitates of an Al—Zn alloy according to Example 2 of the present invention.
Figure 10:
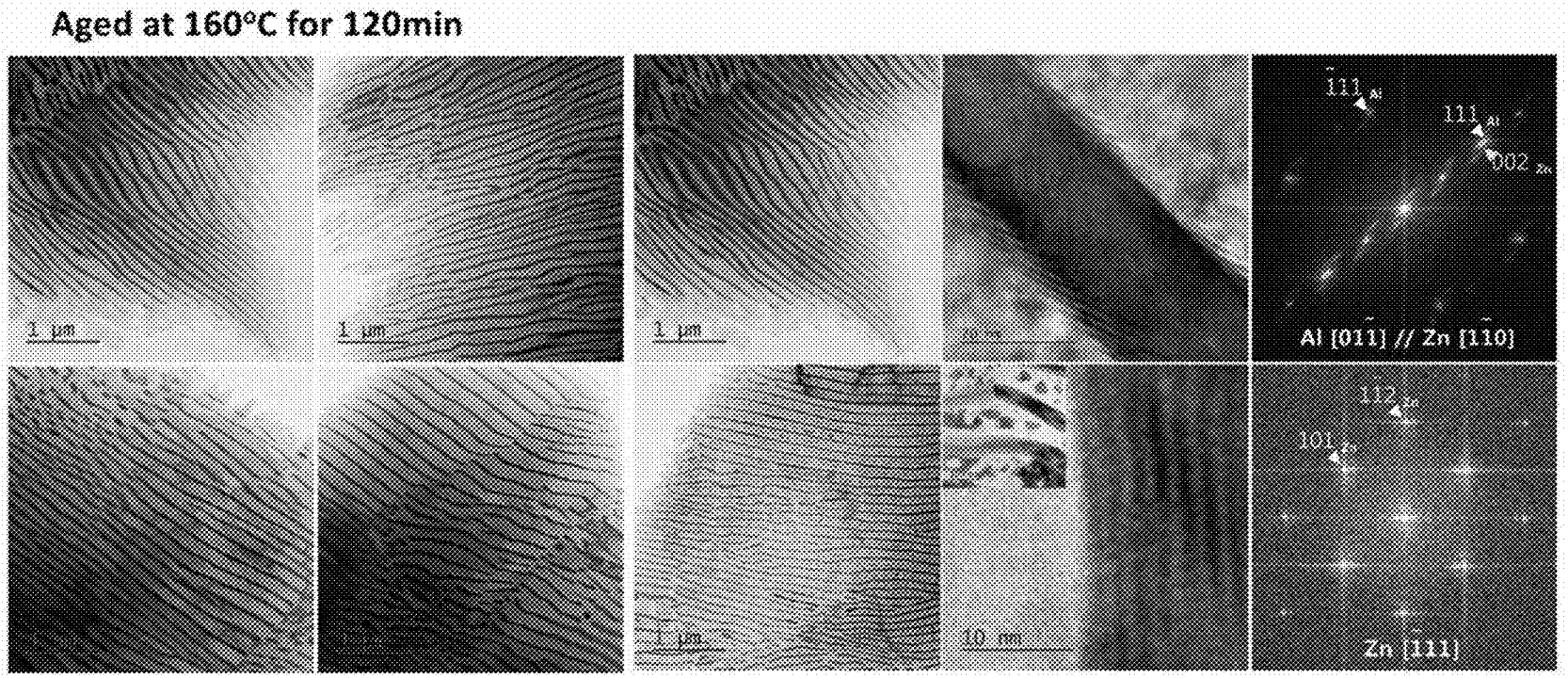
FIG. 10 is TEM images of discontinuous precipitates of an Al—Zn alloy according to Example 7 of the present invention.

FIG. 9 is TEM images of discontinuous precipitates of an Al—Zn alloy according to Example 2 of the present invention. FIG. 10 is TEM images of discontinuous precipitates of an Al—Zn alloy according to Example 7 of the present invention.

Referring to FIG. 9, fibrous discontinuous precipitates are observed, and it is noted that aluminum and zinc has a matching relationship of $(111)_{Al}//(002)_{Al}$, $(011)_{Al}//(110)_{Zn}$.

Referring to FIG. 10, fine zinc precipitates are found between fibrous discontinuous precipitates and discontinuous precipitates.

Figure 11:
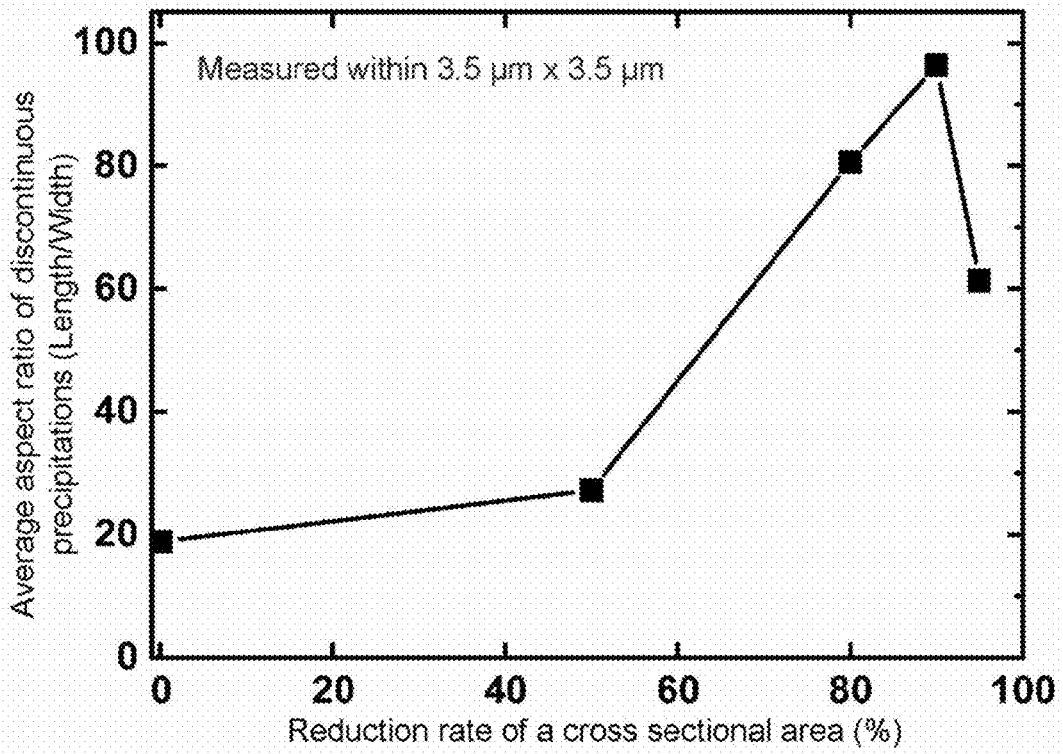
FIG. 11 is a graph illustrating an aspect ratio of discontinuous precipitations of an Al—Zn alloy according to Example 4 of the present invention.
Figure 12:
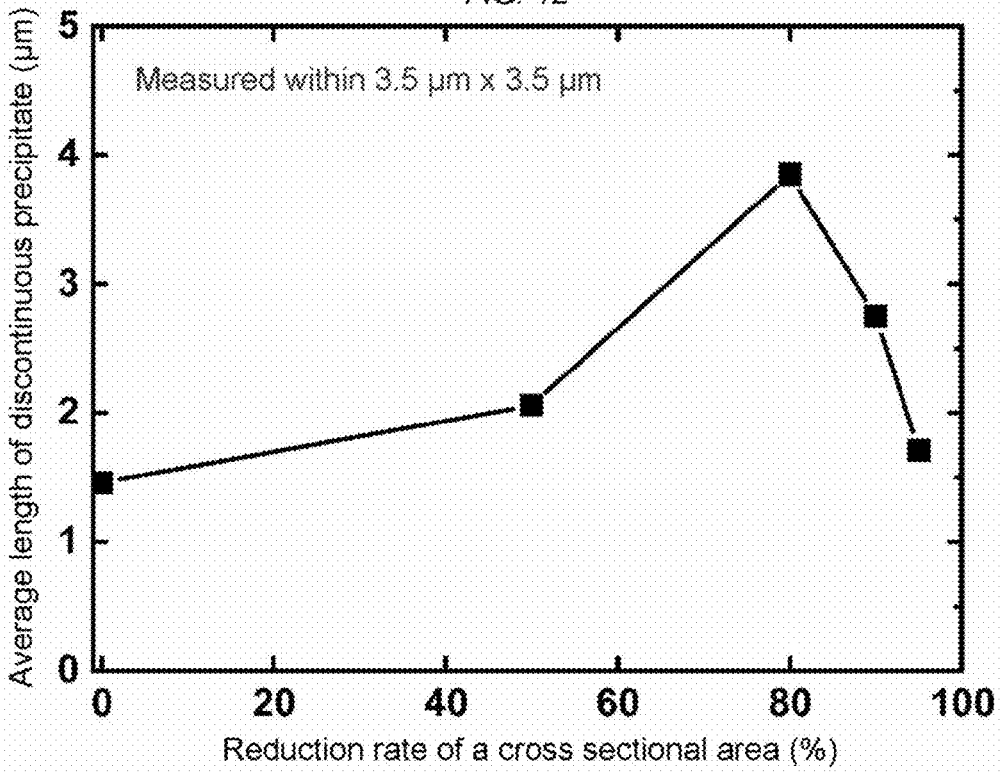
FIG. 12 is a graph illustrating an average length of discontinuous precipitations of an Al—Zn alloy according to Example 4 of the present invention.
Figure 13A:
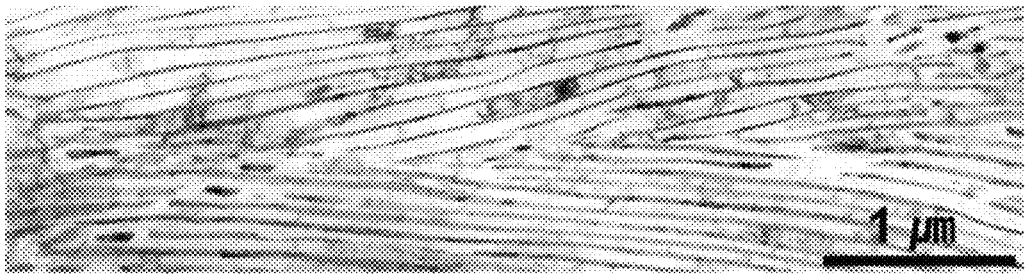
FIG. 13A-FIG. 13D are graphs illustrating an average thickness of discontinuous precipitates of an Al—Zn alloy according to the present invention.
Figure 13B:
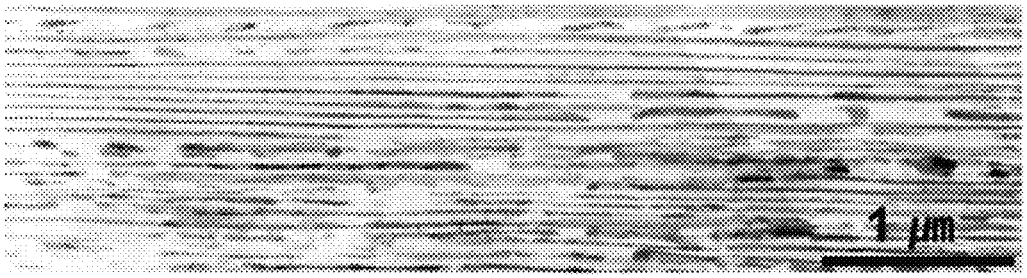
Figure 13C:
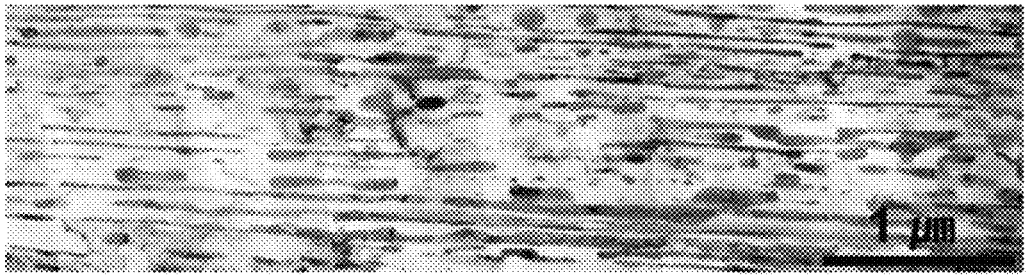
Figure 13D:
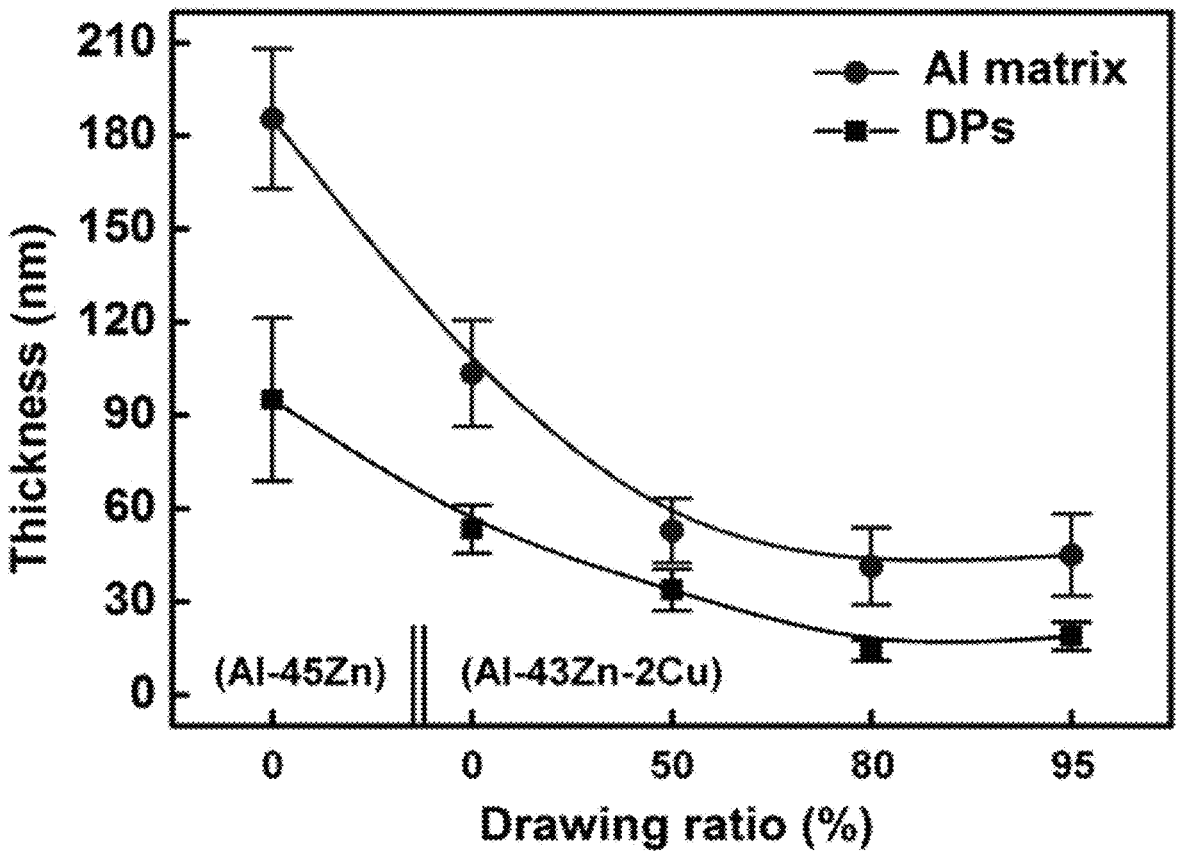

FIG. 11 is a graph illustrating an aspect ratio of discontinuous precipitations of an Al—Zn alloy according to Example 4 of the present invention. FIG. 12 is a graph illustrating an average length of discontinuous precipitations of an Al—Zn alloy according to Example 4 of the present invention. FIG. 13A-FIG. 13D are graphs illustrating an average thickness of discontinuous precipitates of an Al—Zn alloy according to the present invention.

Referring to FIG. 11 to FIG. 13D, the average thickness and spacing of the oriented precipitates decreases as the draw ratio, that is, the reduction rate of the cross sectional area increases. The average aspect ratio and the length increase to 70% and 80%, respectively, but decreases thereafter because the discontinuous precipitates are broken.

Time Dependence Analysis of Aging Process

Figure 14:
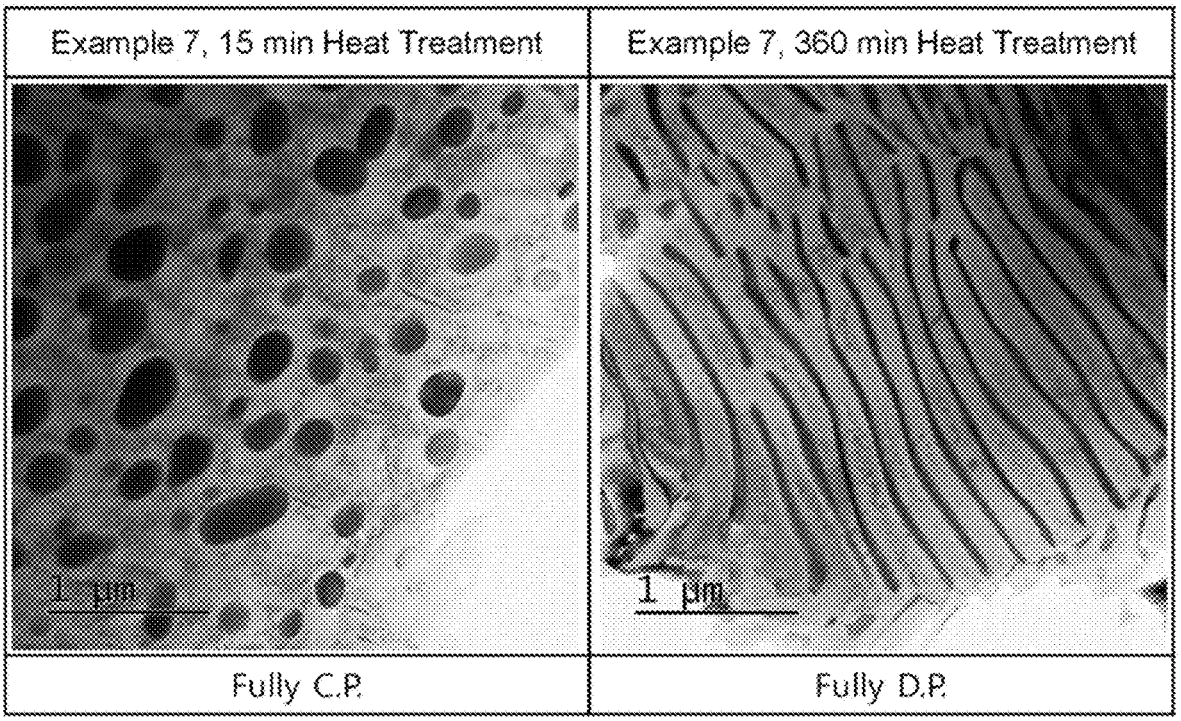
FIG. 14 is TEM images illustrating the effect of the aging time on the formation of discontinuous precipitates of an Al—Zn alloy according to Example 7 of the present invention.

Structures of the precipitates are shown in FIG. 14 when the aging process is performed at 160° C. for 15 minutes and the aging process is performed for 360 minutes after the water quenching process in Example 7, which is a TEM photograph illustrating the influence of the aging time on the formation of discontinuous precipitates of an Al—Zn alloy according to Example 7 of the present invention. Referring to FIG. 14, specimens aged for 15 minute are found to have general precipitates, and specimens aged for 360 minutes are found to have fibrous discontinuous precipitates.

Figure 15:
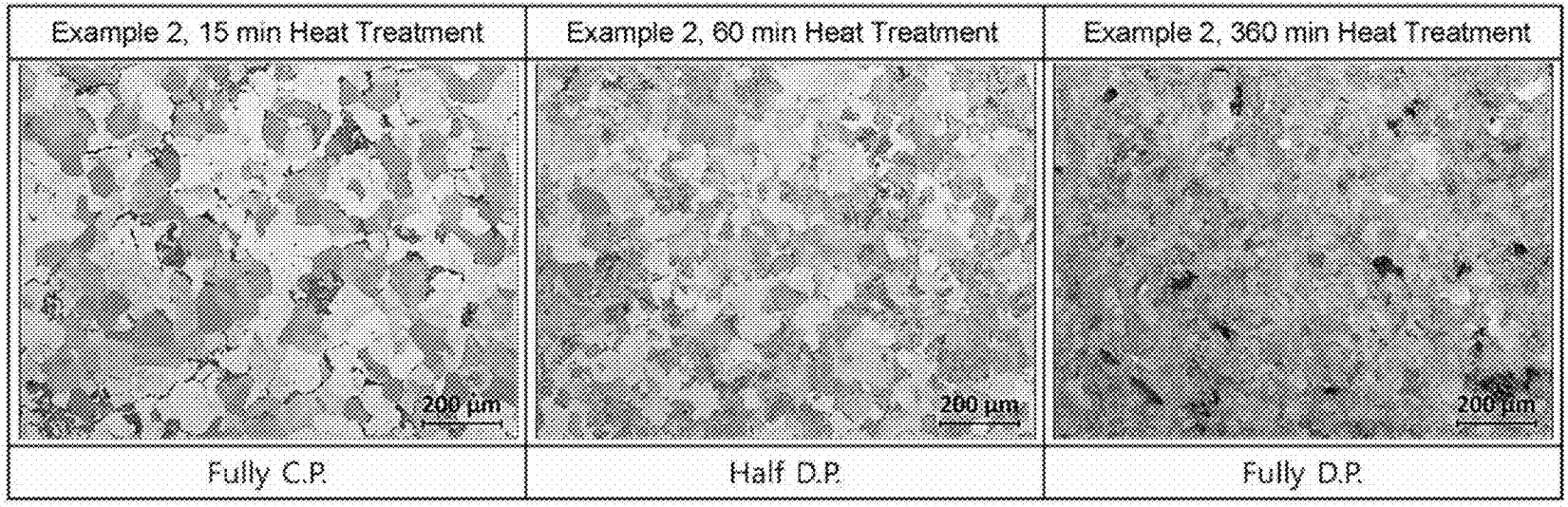
FIG. 15 is photomicrographs illustrating the effect of the aging time on the formation of discontinuous precipitates of the Al—Zn alloy according to Example 2 of the present invention.

FIG. 15 is photomicrographs illustrating the effect of the aging time on the formation of discontinuous precipitates of the Al—Zn alloy according to Example 2 of the present invention. Referring to FIG. 15, it is noted that the area ratio of discontinuous precipitates may be controlled by changing aging time because the area ratio of discontinuous precipitates increases as the aging time is increased.

Figure 16:
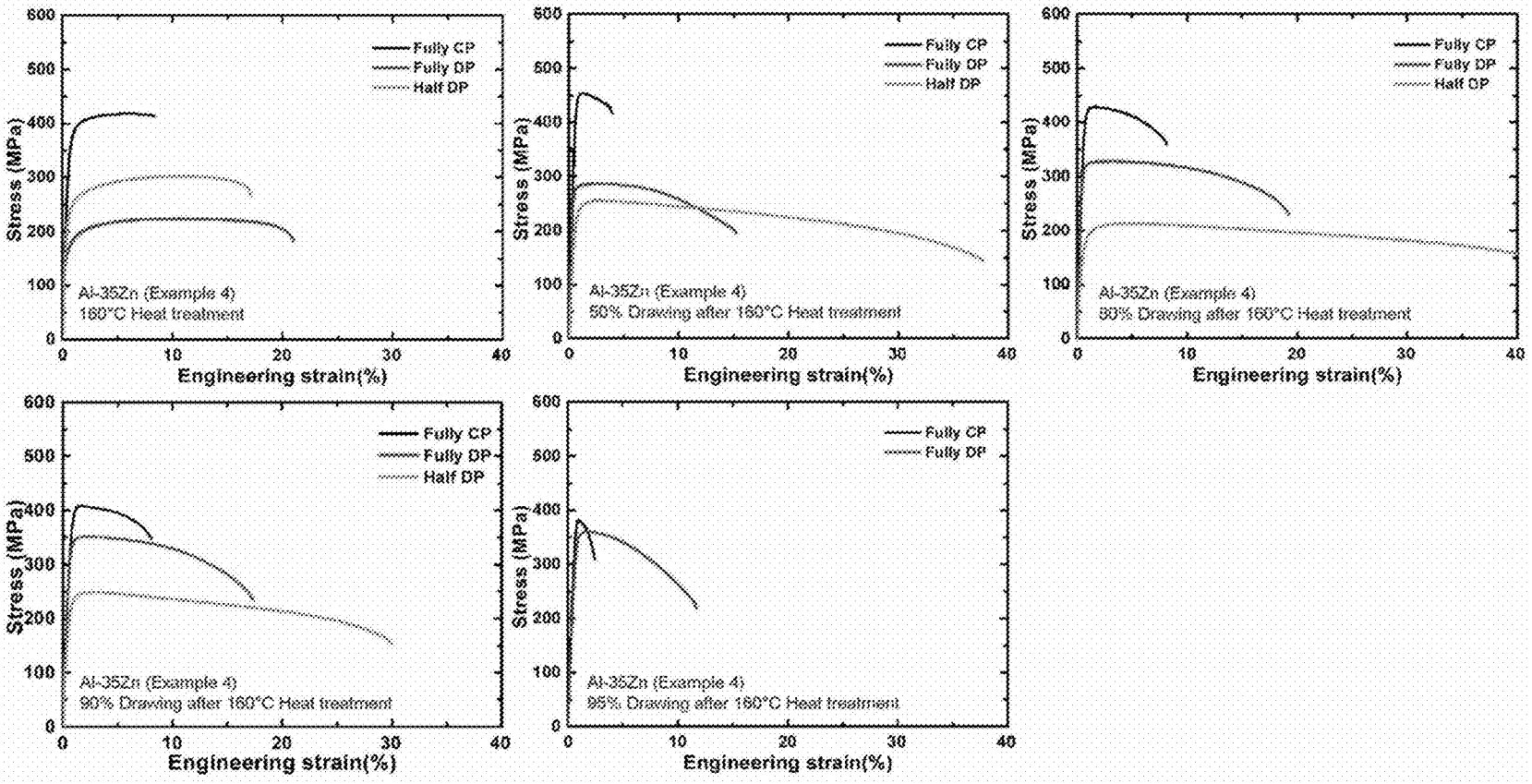
FIG. 16 is graphs illustrating tensile test results of an Al—Zn alloy according to Example 4 of the present invention.

Analysis of Chancres in Tensile Strength and Elongation According to Drawing Ratio FIG. 16 is graphs illustrating tensile test results of an Al—Zn alloy according to Example 4 of the present invention. After the aging process, the stress changes of CP and DP are measured according to the engineering strain after the drawing process. The drawing ratio of the drawing process is 50%, 80%, 90% and 95%. DP and half DP show lower tensile strength, but greater elongation than CP. The elongation of DP and half DP increases up to 80% drawing but decreases thereafter.

Analysis of Properties According to Drawing Conditions

Figure 17:
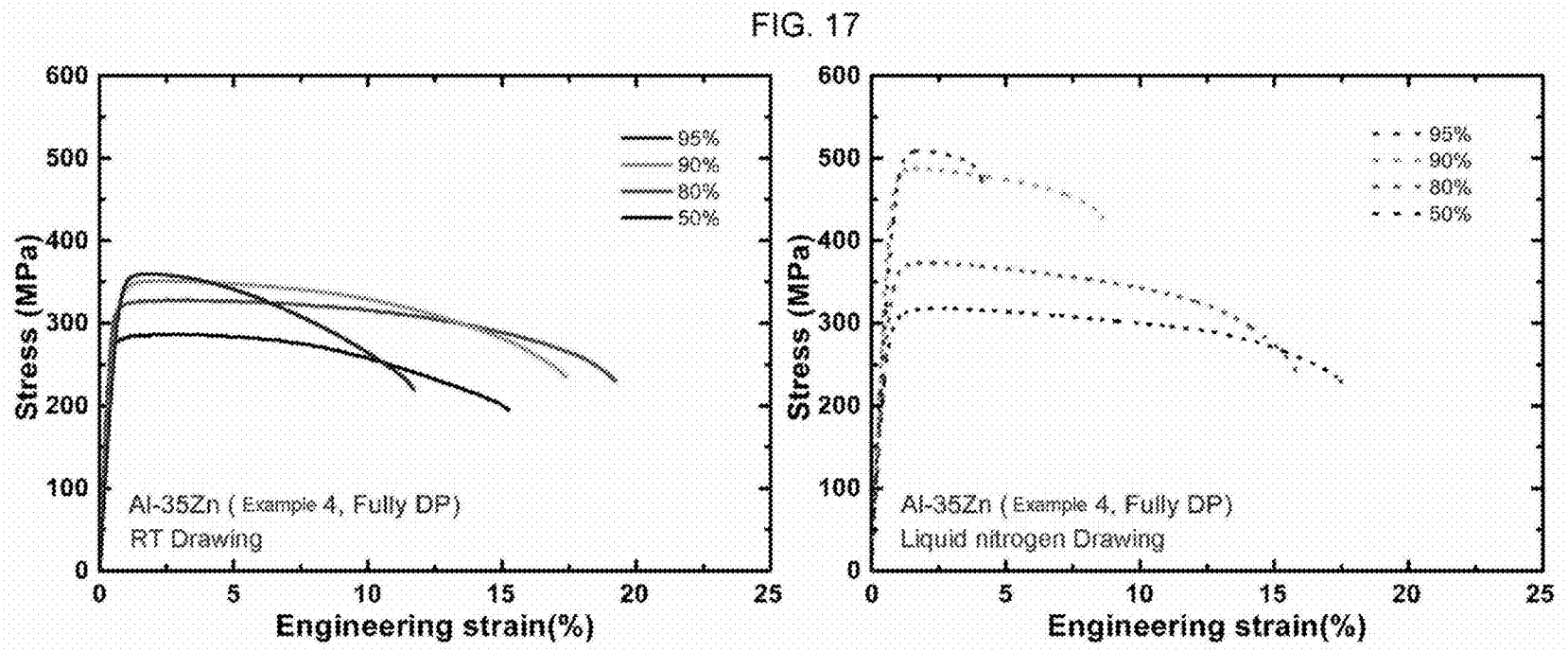
FIG. 17 is graphs illustrating tensile test results of an Al—Zn alloy according to Example 4 of the present invention after room temperature and liquid nitrogen drawing.
Figure 18:
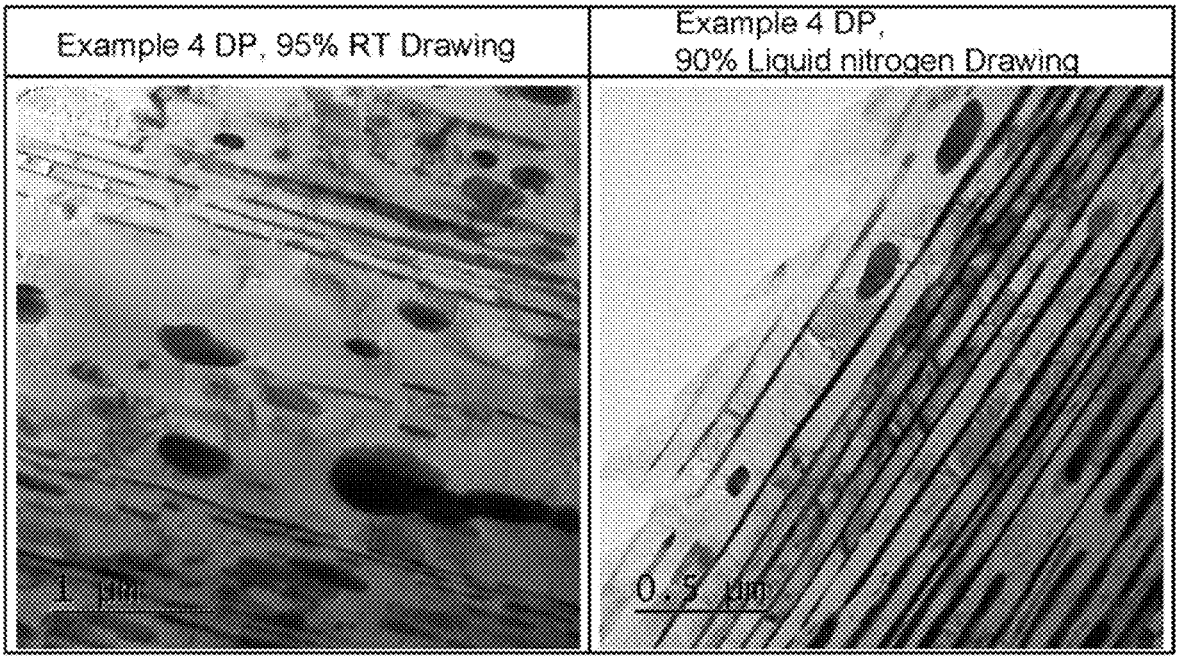
FIG. 18 is TEM images illustrating the shape of precipitates of an Al—Zn alloy according to Example 4 of the present invention after room temperature and liquid nitrogen drawing.

FIG. 17 is graphs illustrating tensile test results, measured according to the engineering strain after room temperature and liquid nitrogen drawing, of an Al—Zn alloy according to Example 4 of the present invention. Referring to FIG. 17, when drawn in a liquid nitrogen atmosphere, the tensile strength is much higher than the DP drawn at room temperature FIG. 18 is TEM images illustrating the shape of precipitates of an Al—Zn alloy according to Example 4 of the present invention after room temperature and liquid nitrogen drawing. Referring to FIG. 18, after the drawing process at room temperature, discontinuous precipitates disappeared and zinc precipitates become spherical, while discontinuous precipitates are relatively large after liquid nitrogen drawing, and are elongated along the draw direction.

Analysis of Discontinuous Precipitate Properties according to Cu Addition

Figure 19:
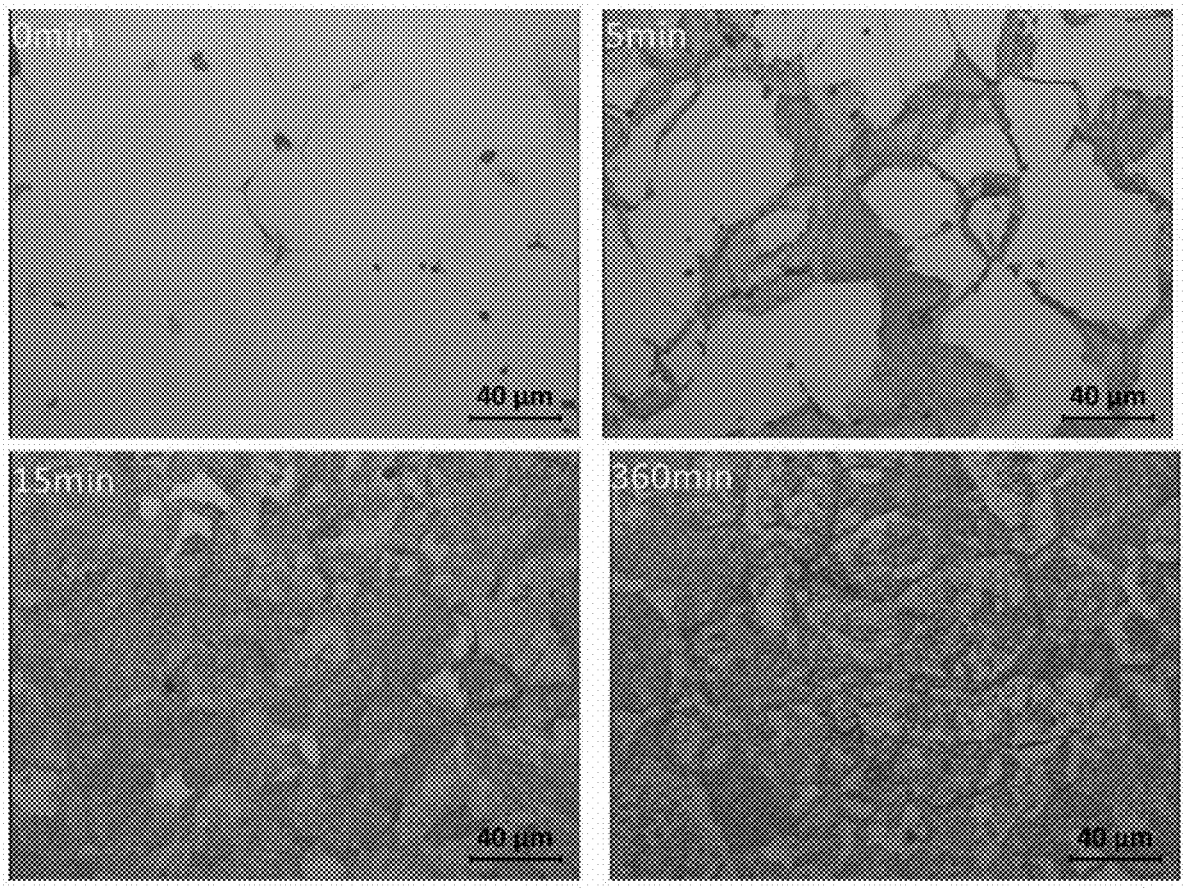
FIG. 19 is photomicrographs illustrating the shape of the precipitates according to the aging time of an Al—Zn alloy according to Example 12 of the present invention.
Figure 20:
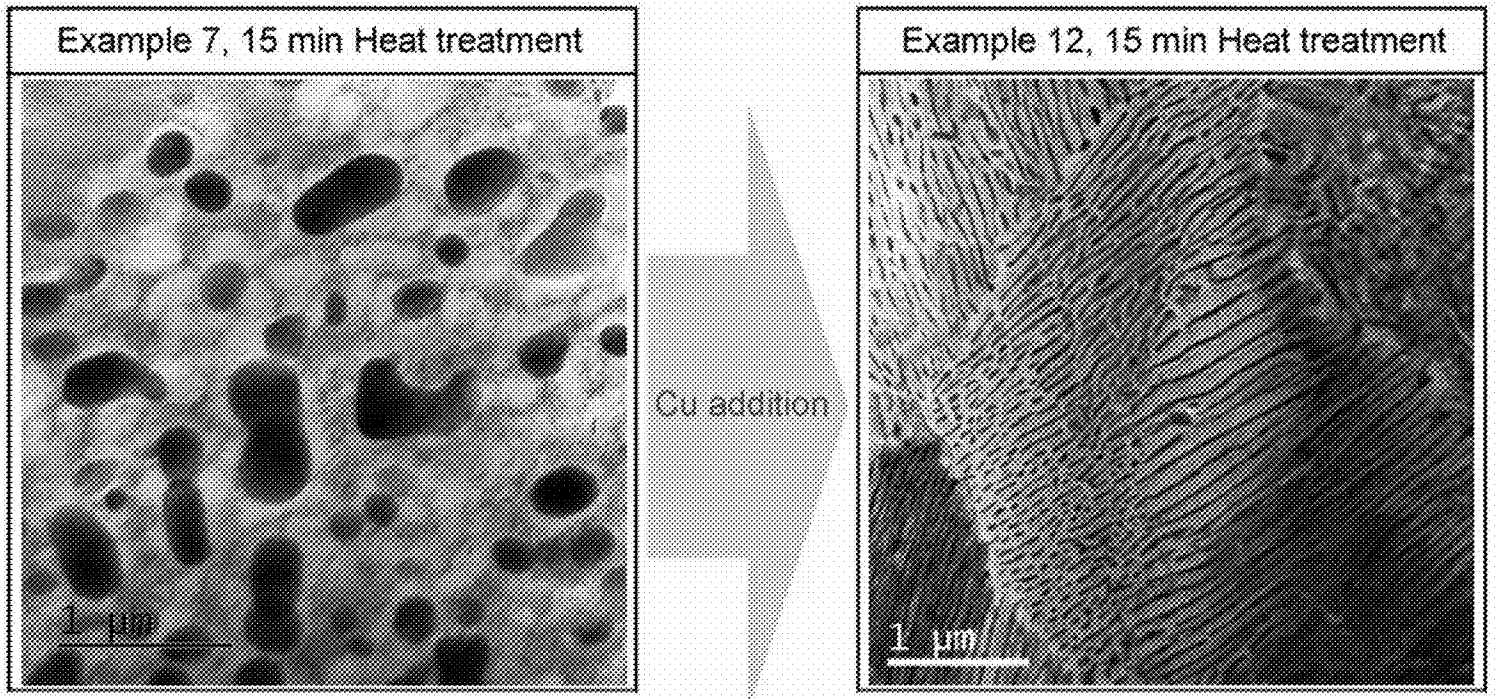
FIG. 20 is TEM images illustrating the change of heat treatment time for formation of discontinuous precipitates by adding copper to an Al—Zn alloy of the present invention.

FIG. 19 is photomicrographs illustrating the shape of the precipitates according to the aging time of an Al—Zn alloy according to Example 12 of the present invention. FIG. 20 is TEM images illustrating the change of heat treatment time for formation of discontinuous precipitates by adding copper to an Al—Zn alloy of the present invention. Referring to FIGS. 19 and 20, the addition of Cu accelerates the formation rate of discontinuous precipitates, resulting in the formation of DP (fully DP) throughout the microstructure even with the 15 minute aging treatment.

Figure 21:
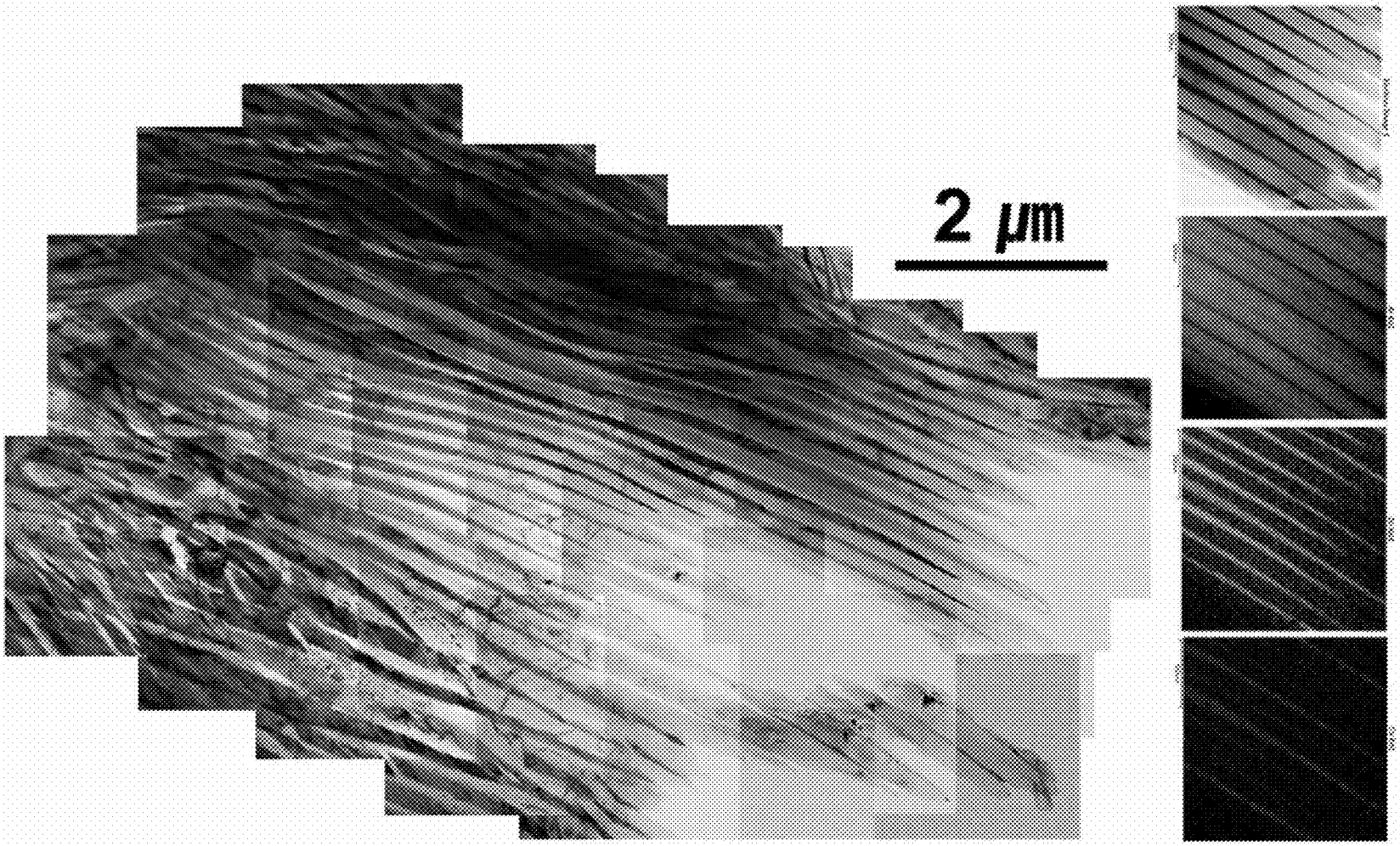
FIG. 21 is TEM images of an Al—Zn alloy according to Example 12 of the present invention after aging treatment.

FIG. 21 is TEM images of an Al—Zn alloy according to Example 12 of the present invention after aging treatment at 160° C. for 360 minutes. Referring to FIG. 21, copper is observed to be dissolved in zinc discontinuous precipitates.

Figure 22:
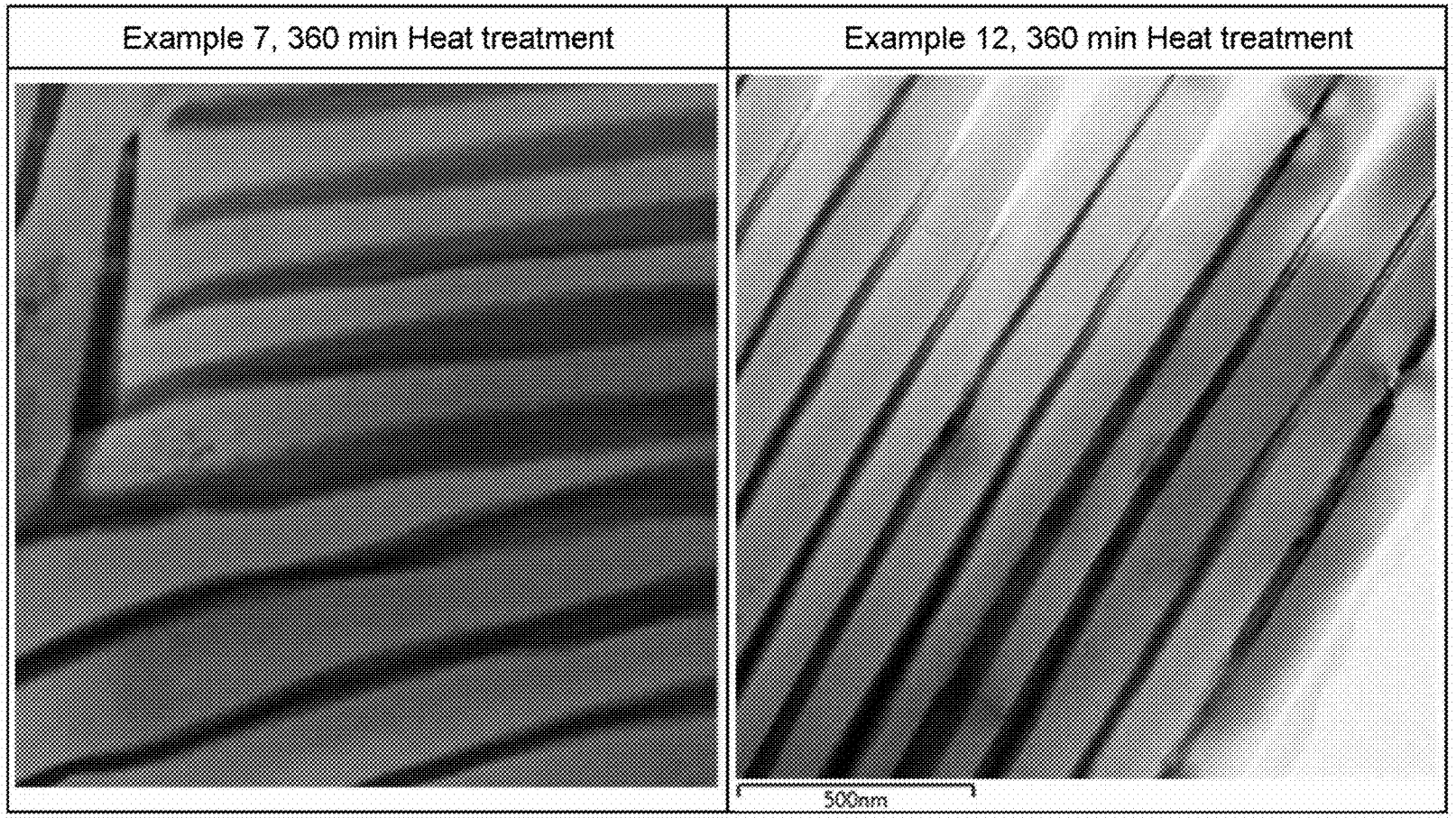
FIG. 22 is TEM images illustrating the effect of adding copper on the size of discontinuous precipitates in an Al—Zn alloy according to Example 12 of the present invention.

FIG. 22 is TEM images illustrating the effect of addition of copper on the size of discontinuous precipitates after adding copper to an Al—Zn alloy according to Example 12 of the present invention and aging at 60° C. for 360 minutes. Referring to FIG. 22, copper is observed to be dissolved in zinc discontinuous precipitates to reduce the thickness of zinc discontinuous precipitates and the distance between precipitates and improve the strength of zinc discontinuous precipitates.

Analysis of Tensile Strength and Elongation After Drawing

Figure 23:
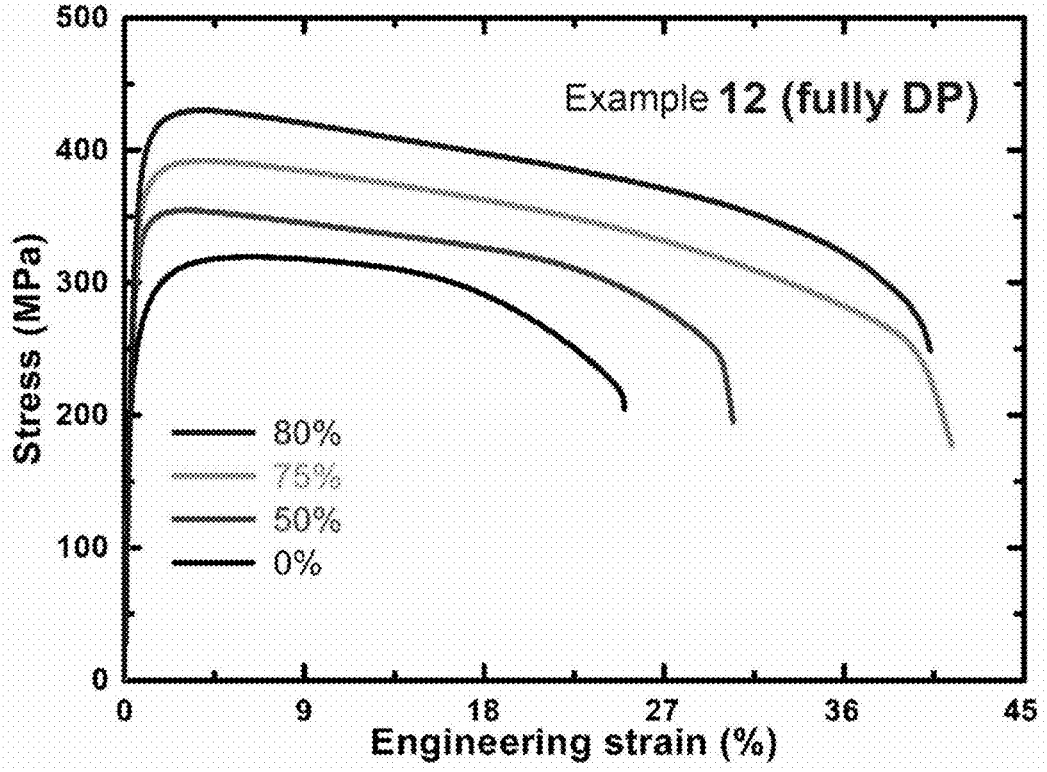
FIG. 23 is a graph illustrating that the strength and the elongation of an Al—Zn alloy according to Example 12 of the present invention increase at the same time.
Figure 24:
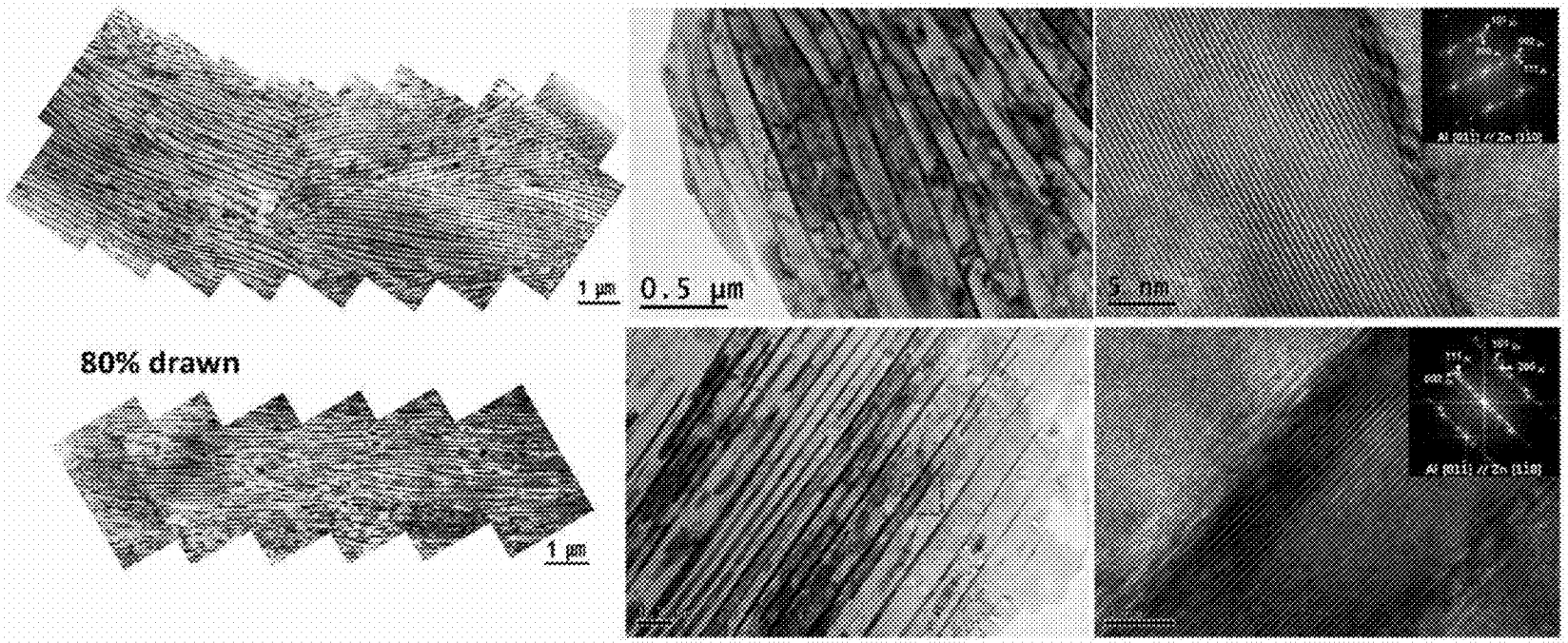
FIG. 24 is TEM images illustrating the shape of discontinuous precipitates according to the draw ratio of an Al—Zn alloy according to Example 12 of the present invention.

FIG. 23 is a graph illustrating that the strength and the elongation of an Al—Zn alloy according to Example 12 of the present invention increase at the same time. FIG. 24 is TEM images illustrating the shape of discontinuous precipitates according to the draw ratio of an Al—Zn alloy according to Example 12 of the present invention.

Referring to FIG. 23 and FIG. 24, the strength and the elongation of the Al—Zn alloy including copper are increased at the same time when drawn at room temperature. As drawing is increased, the zinc discontinuous precipitates are aligned in the drawing direction without breaking, and the thickness of precipitates and the distance between precipitates is decreased.

Figure 25:
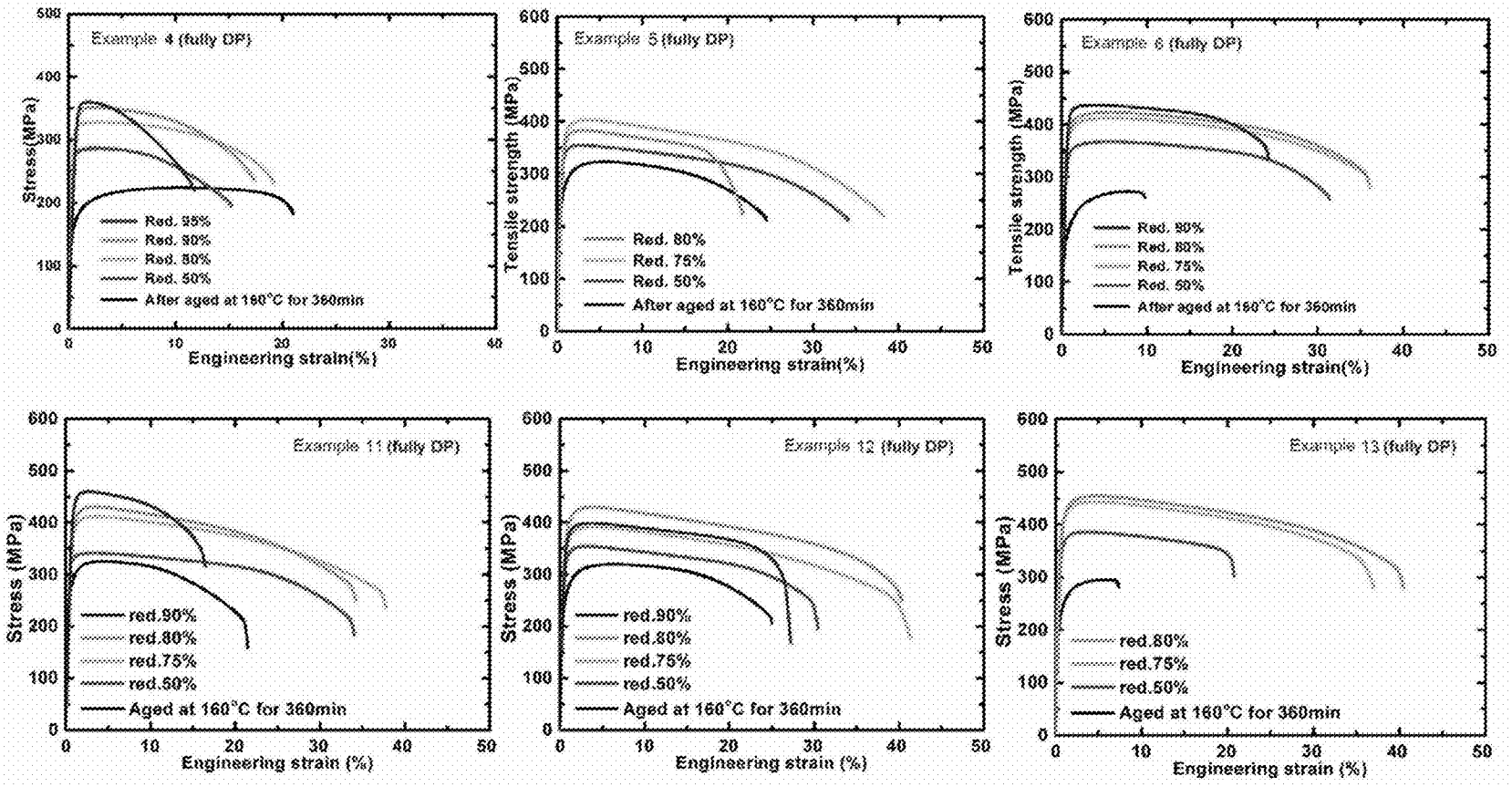
FIG. 25 is graphs illustrating tensile test results of alloy compositions of an Al—Zn alloy according to embodiments of the present invention.
Figure 26:
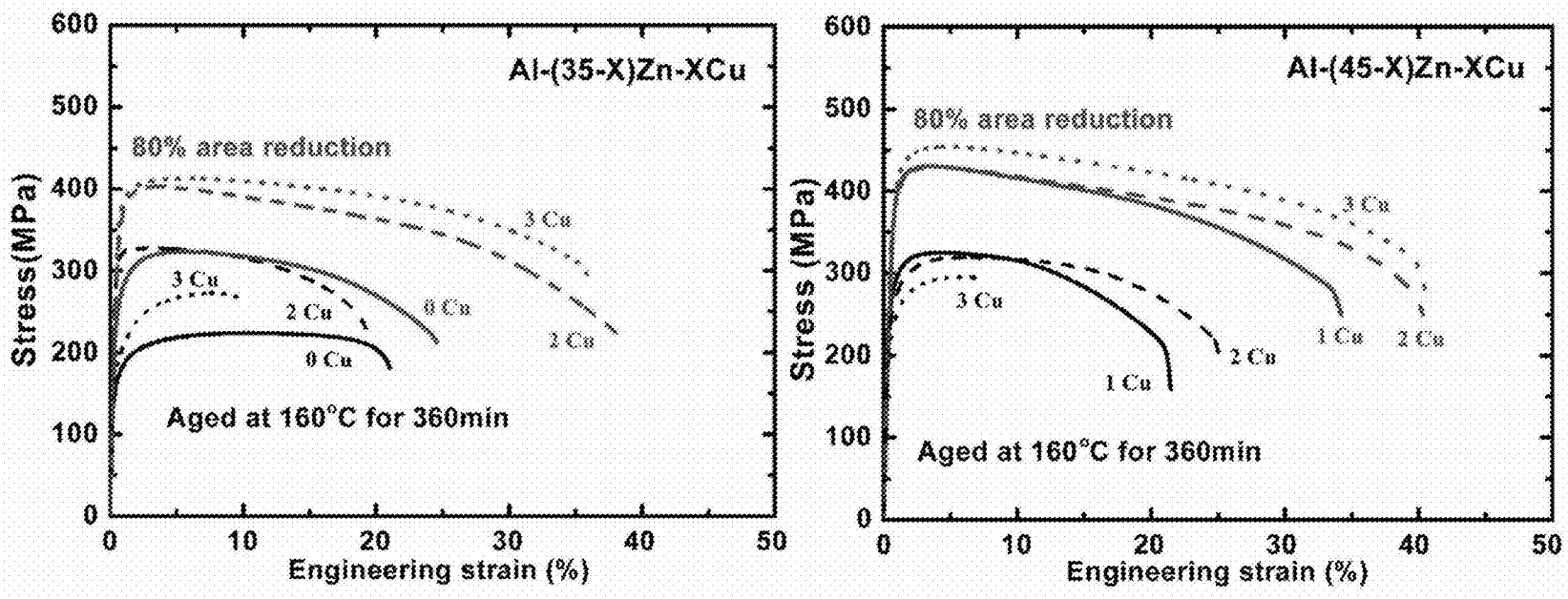
FIG. 26 is graphs illustrating tensile test results of an Al—Zn alloy according to embodiments of the present invention after 80% of drawing by Cu addition.

FIG. 25 is graphs illustrating tensile test results of alloy compositions of an Al—Zn alloy according to embodiments of the present invention. FIG. 26 is graphs illustrating tensile test results of an Al—Zn alloy according to embodiments of the present invention before and after 80% of drawing. Referring to FIG. 25 and FIG. 26, the tensile strength is increased by Cu addition, and the tensile strength and the elongation of the Al—Zn alloy including copper are simultaneously improved after 80% drawing.

Figure 27:
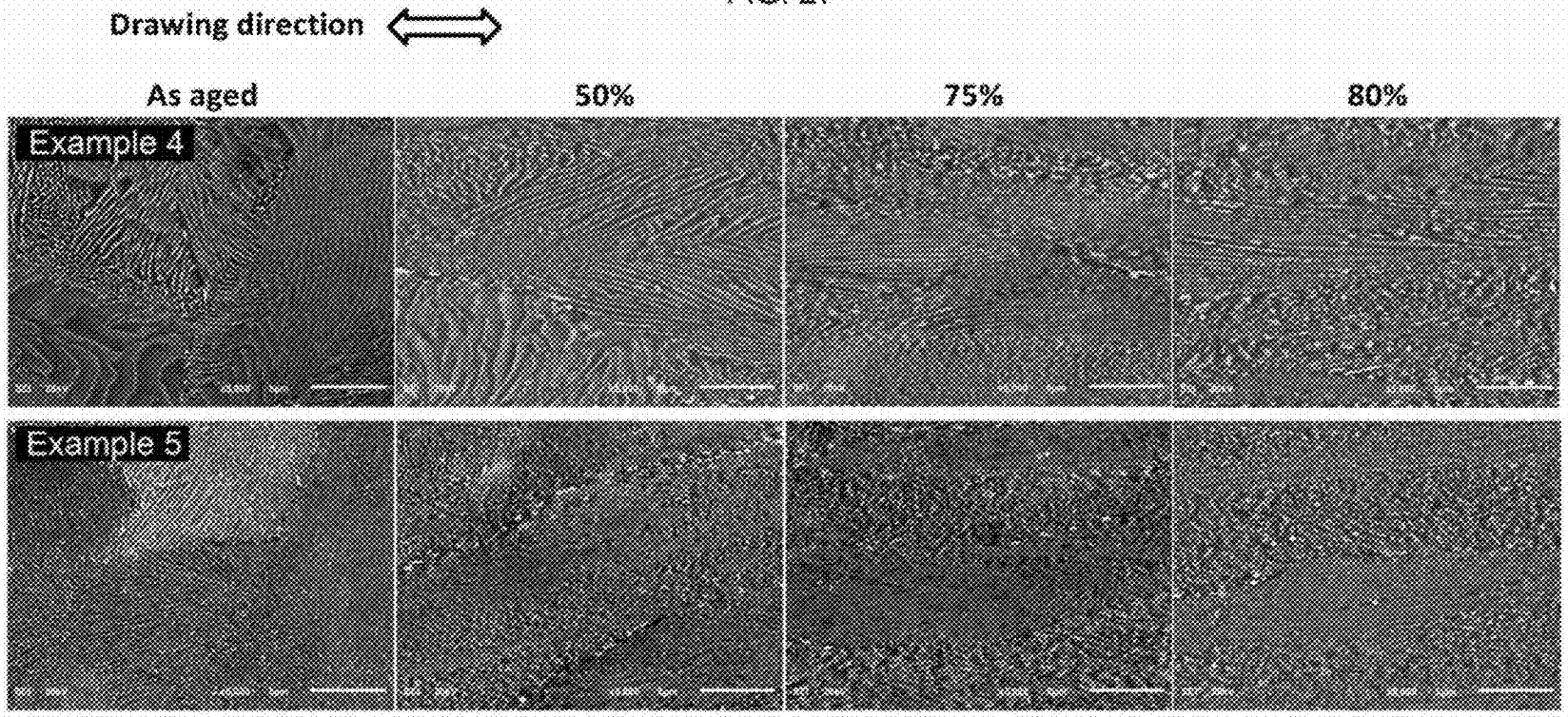
FIG. 27 is SEM images illustrating that the discontinuous precipitates of Al—Zn alloys according to Examples 4 and 5 of the present invention are aligned in a drawing direction.

FIG. 27 is SEM images illustrating that the discontinuous precipitates of Al—Zn alloys according to Examples 4 and 5 of the present invention are aligned in a drawing direction. Referring to FIG. 27, discontinuous precipitates are aligned in a drawing direction in the presence or absence of copper.

Figure 28:
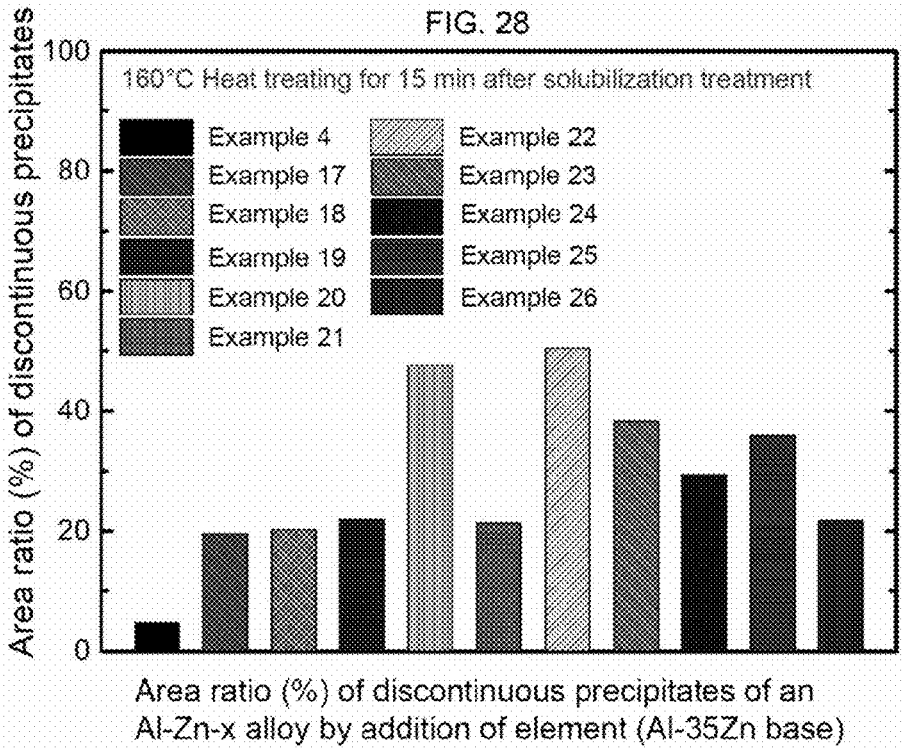
FIG. 28 is a graph illustrating the effect of precipitation-accelerating metal addition on the formation of discontinuous precipitates in an Al—Zn alloy according to the embodiments of the present invention.

FIG. 28 is a graph illustrating the effect of precipitation-accelerating metal addition on the formation of discontinuous precipitates in an Al—Zn alloy according to the embodiments of the present invention. Referring to FIG. 28, when copper and elements such as Ti, Si, Fe, Mn, Mg, and Cr are added, formation of discontinuous precipitates is promoted.

Table 2 shows processing rate, tensile strength and elongation of the Al—Zn alloy according to Examples of the present invention.

TABLE 2

| Category | Processing Temp | Precipitate Form | Processing Rate (Red. %) | Tensile Strength (MPa) | Elongation (%) |
|---|---|---|---|---|---|
| Example 4 | RT | CP | 0 | 418 | 7.8 |
| | | | 50 | 454 | 3.4 |
| | | | 80 | 429 | 7.6 |
| | | | 90 | 408 | 7.3 |
| | | | 95 | 381 | 1.9 |
| | | DP | 0 | 224 | 20.2 |
| | | | 50 | 286 | 15 |
| | | | 80 | 328 | 18.7 |
| | | | 90 | 352 | 17.2 |
| | | | 95 | 360 | 11.5 |
| | | Half DP | 0 | 300 | 16.8 |
| | | | 50 | 255 | 37.4 |
| | | | 80 | 211 | 50.1 |
| | | | 90 | 248 | 29.7 |
| | Liquid Nitrogen | DP | 50 | 318 | 16.7 |
| | | | 80 | 373 | 15.0 |
| | | | 90 | 488 | 7.6 |
| | | | 95 | 510 | 3.0 |
| Example 5 | RT | DP | 0 | 323 | 23.9 |
| | | | 50 | 355 | 32.4 |
| | | | 75 | 404 | 37.9 |
| | | | 80 | 383 | 21.1 |
| Example 6 | RT | DP | 0 | 273 | 9.5 |
| | | | 50 | 368 | 31.2 |
| | | | 75 | 412 | 35.7 |
| | | | 80 | 423 | 35.7 |
| | | | 90 | 437 | 24.0 |
| Example 11 | RT | DP | 0 | 325 | 21 |
| | | | 50 | 342 | 33.6 |
| | | | 75 | 411 | 37.2 |
| | | | 80 | 431 | 33.9 |
| | | | 90 | 460 | 16.1 |
| Example 12 | RT | DP | 0 | 320 | 24.5 |
| | | | 50 | 354 | 30.0 |
| | | | 75 | 398 | 40.9 |
| | | | 80 | 430 | 39.7 |
| | | | 90 | 400 | 27.0 |
| Example 13 | RT | DP | 0 | 292 | 6.9 |
| | | | 50 | 386 | 20.3 |
| | | | 75 | 444 | 36.6 |
| | | | 80 | 455 | 40.1 |

FIG. 29 is a graph illustrating that tensile strength and elongation of the Al—Zn alloy according to the present invention are improved at the same time as compared with the conventional alloy regardless of the addition of copper.

The spirit of the present disclosure has been described by way of example hereinabove, and the present disclosure may be variously modified, altered, and substituted by those skilled in the art to which the present disclosure pertains without departing from essential features of the present disclosure. Accordingly, the exemplary embodiments disclosed in the present disclosure and the accompanying drawings do not limit but describe the spirit of the present disclosure, and the scope of the present disclosure is not limited by the exemplary embodiments and accompanying drawings. The scope of the present disclosure should be interpreted by the following claims and it should be interpreted that all spirits equivalent to the following claims fall within the scope of the present disclosure.

What is claimed is:

1. An Al—Zn alloy comprising:

zinc, wherein an amount of zinc is more than 20 parts by weight and less than 50 parts by weight based on 100 parts by weight of the Al—Zn alloy;

aluminum; and unavoidable impurities, wherein the Al—Zn alloy further comprises a precipitation accelerating metal, the precipitation accelerating metal is at least one selected from the group consisting of 0.05 to 5 parts by weight of copper, 0.05 to 0.1 parts by weight of titanium, 0.1 to 0.3 parts by weight of silicon, 0.1 to 0.5 parts by weight of iron, 0.1 to 0.5 parts by weight of manganese, 0.1 to 5 parts by weight of magnesium, and 0.1 to 3 parts by weight of chromium, the Al—Zn alloy comprises discontinuous precipitates or lamellar precipitates, the discontinuous precipitates or lamellar precipitates are formed forcibly in 5% or more per unit area and are oriented, an average spacing between the precipitates of the discontinuous precipitates or the lamellar precipitates is 105 nm or less, and the Al—Zn alloy has improved strength and elongation.

2. The Al—Zn alloy of claim 1, wherein an average thickness of the discontinuous precipitates or the lamellar precipitates is 55 nm or less.

3. The Al—Zn alloy of claim 1, wherein the discontinuous precipitates or the lamellar precipitates are formed by heat treating the Al—Zn alloy to form solid solution and then aging the Al—Zn alloy.

4. The Al—Zn alloy of claim 1, wherein the precipitation accelerating metal is copper, and the copper is included in an amount of 0.05 to 5 parts by weight based on the total weight of the alloy.

5. The Al—Zn alloy of claim 1, wherein the elongation is at least 10% when the tensile strength is 300 MPa to 400 Mpa.

6. The Al—Zn alloy of claim 1, wherein the elongation is at least 5% the tensile strength is 400 MPa to 500 MPa.

7. An Al—Zn alloy comprising:

zinc, wherein an amount of zinc is more than 20 parts by weight and less than 50 parts by weight based on 100 parts by weight of the Al—Zn alloy;

aluminum; and unavoidable impurities, wherein the Al—Zn alloy further comprises a precipitation accelerating metal, the precipitation accelerating metal is at least one selected from the group consisting of 0.05 to 5 parts by weight of copper, 0.05 to 0.1 parts by weight of titanium, 0.1 to 0.3 parts by weight of silicon, 0.1 to 0.5 parts by weight of iron, 0.1 to 0.5 parts by weight of manganese, 0.1 to 5 parts by weight of magnesium, and 0.1 to 3 parts by weight of chromium, the Al—Zn alloy comprises discontinuous precipitates or lamellar precipitates, the discontinuous precipitates or the lamellar precipitates have an average aspect ratio of at least 20 and are oriented precipitates, an average spacing between the precipitates of the discontinuous precipitates or the lamellar precipitates is 105 nm or less, and the Al—Zn alloy has improved strength and elongation.

8. An Al—Zn alloy comprising:

zinc, wherein an amount of zinc is more than 20 parts by weight and less than 50 parts by weight based on 100 parts by weight of the Al—Zn alloy;

aluminum; and unavoidable impurities, wherein the Al—Zn alloy further comprises a precipitation accelerating metal, the precipitation accelerating metal is at least one selected from the group consisting of 0.05 to 5 parts by weight of copper, 0.05 to 0.1 parts by weight of titanium, 0.1 to 0.3 parts by weight of silicon, 0.1 to 0.5 parts by weight of iron, 0.1 to 0.5 parts by weight of manganese, 0.1 to 5 parts by weight of magnesium, and 0.1 to 3 parts by weight of chromium, the Al—Zn alloy comprises discontinuous precipitates or lamellar precipitates, the discontinuous precipitates or the lamellar precipitates have an average length of at least 1.4 μm and are oriented precipitates, an average spacing between the precipitates of the discontinuous precipitates or the lamellar precipitates is 105 nm or less, and the Al—Zn alloy has improved strength and elongation.

9. A method for manufacturing an Al—Zn alloy with improved strength and elongation at the same time of claim 1, the method comprising:

preparing an Al—Zn alloy having a composition of claim 1;

forming a solid solution by heat treating the Al—Zn alloy;

aging the Al—Zn alloy comprising the solid solution to force forming 5% or more of discontinuous precipitates or lamellar precipitates per unit area; and orienting to form oriented precipitates by calcining the Al—Zn alloy comprising the precipitates.

10. The method of claim 9, wherein the heat treating is performed by heating at a temperature range of 350 to 450° C. for 120 minutes or more.

11. The method of claim 9, wherein the aging is performed at a temperature of 120 to 200° C. for 5 minutes to 400 minutes.

12. The method of claim 9, wherein the precipitation accelerating metal is copper, and the copper is included in an amount of 0.05 to 5 parts by weight based on the total weight of the alloy.

13. The method of claim 9, wherein the orienting is performed with a plastic working of 50% or more.

14. The method of claim 9, wherein the orienting is performed in a liquid nitrogen atmosphere.

* * * * *